US011253048B2

(12) United States Patent
Logan et al.

(10) Patent No.: US 11,253,048 B2
(45) **Date of Patent: *Feb. 22, 2022**

(54) LUGGAGE SYSTEMS

(71) Applicant: Onli Travel LLC, Chestnut Hill, MA (US)

(72) Inventors: David S. Logan, Chestnut Hill, MA (US); Martin D. Wahl, Portland, OR (US)

(73) Assignee: ONLI TRAVEL, LLC, Chestnut Hill, MA (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/877,824

(22) Filed: May 19, 2020

(65) Prior Publication Data

US 2020/0352310 A1 Nov. 12, 2020

Related U.S. Application Data

(63) Continuation of application No. 16/102,579, filed on Aug. 13, 2018, now Pat. No. 10,694,834.
(Continued)

(51) Int. Cl.
*A45F 3/00* (2006.01)
*A45F 3/04* (2006.01)
(Continued)

(52) U.S. Cl.
CPC ..... *A45F 3/047* (2013.01); *A45C 5/14* (2013.01); *A45C 5/141* (2013.01); *A45C 7/0027* (2013.01);
(Continued)

(58) Field of Classification Search
CPC ..... A45F 3/047; A45F 4/02; A45F 2003/001; A45F 2003/045; A45F 2004/006;
(Continued)

(56) References Cited

U.S. PATENT DOCUMENTS 4,081,061 A 3/1978 Tucker
4,236,657 A 12/1980 Brunton
(Continued)

OTHER PUBLICATIONS

"Luggage Systems" Specification, Drawings and Prosecution History of U.S. Appl. No. 16/102,579, filed Aug. 13, 2018, now issued U.S. Pat. No. 10,694,834, issued on Jun. 30, 2020 by David S. Logan, et al.

*Primary Examiner* — Peter N Helvey
(74) *Attorney, Agent, or Firm* — Onello & Mello, LLP

(57) ABSTRACT

A system comprises a first body, comprising: a backpack suspension; a first storage region; and a first portion of a first attachment mechanism. A second body comprises: a second storage region; and a first portion of a second attachment mechanism. A third body comprises: a third storage region; a second portion of the first attachment mechanism; and a second portion of the second attachment mechanism. In a first configuration, the first portion of the first attachment mechanism is coupled to the first portion of the second attachment mechanism. In a second configuration, the first portion of the first attachment mechanism is coupled to the second portion of the first attachment mechanism, and the first portion of the second attachment mechanism is coupled to the second portion of the second attachment mechanism.

20 Claims, 31 Drawing Sheets

Related U.S. Application Data

(60) Provisional application No. 62/544,294, filed on Aug. 11, 2017.

(51) Int. Cl.

| | |
|---|---|
| ***A45F 4/02*** | (2006.01) |
| ***A45C 5/14*** | (2006.01) |
| ***A45C 7/00*** | (2006.01) |
| *A45C 5/03* | (2006.01) |
| *A45F 4/00* | (2006.01) |
| *A45C 9/00* | (2006.01) |

(52) U.S. Cl.

CPC ..... *A45C 7/0045* (2013.01); *A45F 4/02* (2013.01); *A45C 2005/032* (2013.01); *A45C 2009/007* (2013.01); *A45F 2003/001* (2013.01); *A45F 2003/045* (2013.01); *A45F 2004/006* (2013.01)

(58) Field of Classification Search

CPC ..... A45C 5/14; A45C 5/141; A45C 7/0027; A45C 7/0045; A45C 2005/032; A45C 2009/007

USPC ..... 224/153

See application file for complete search history.

(56) References Cited

U.S. PATENT DOCUMENTS

| | | | |
|---|---|---|---|
| 4,491,258 | A | 1/1985 | Jones |
| 4,901,897 | A | 2/1990 | Briggs et al. |
| 5,407,112 | A | 4/1995 | Christodoulou et al. |
| 5,544,792 | A | 8/1996 | Arnwine |
| 5,547,052 | A | 8/1996 | Latshaw |
| 5,560,479 | A | 10/1996 | Leyba et al. |
| 5,566,797 | A | 10/1996 | Van Himbeeck |
| 5,628,443 | A | 5/1997 | Deutsch |
| 5,729,869 | A | 3/1998 | Anscher |
| 5,875,876 | A | 3/1999 | Wang |
| 5,887,770 | A | 3/1999 | Covell |
| 6,015,072 | A | 1/2000 | Young |
| 6,098,769 | A | 8/2000 | Yen |
| 6,109,402 | A | 8/2000 | Godshaw et al. |
| 6,189,750 | B1 | 2/2001 | Von Neumann |
| 6,213,266 | B1 | 4/2001 | Hollingsworth |
| 6,213,267 | B1 | 4/2001 | Miller |
| 6,216,926 | B1 | 4/2001 | Pratt |
| 6,305,587 | B1 | 10/2001 | Miller |
| 6,502,676 | B2 | 1/2003 | Dexheimer |
| 6,629,629 | B2 | 10/2003 | Lee et al. |
| 6,742,684 | B2 | 6/2004 | Oh |
| 7,021,437 | B2 | 4/2006 | Ghiassi |
| 7,124,921 | B1 | 10/2006 | Hubbell |
| 7,232,018 | B1 | 6/2007 | Salander |
| 7,322,452 | B2 | 1/2008 | Nykoluk |
| 7,588,146 | B1 | 9/2009 | Salander et al. |
| 7,757,911 | B2 | 7/2010 | Barker |
| D647,302 | S | 10/2011 | Hoang |
| 8,079,452 | B2 | 12/2011 | Drew et al. |
| 8,459,518 | B2 | 6/2013 | Demsky |
| 8,567,578 | B2 | 10/2013 | Cuong et al. |
| 8,584,917 | B2 | 11/2013 | Hexels |
| 8,678,253 | B2 | 3/2014 | Graham |
| 8,683,650 | B2 | 4/2014 | Scicluna |
| 8,919,628 | B2 | 12/2014 | Jamlang |
| 9,027,813 | B2 | 5/2015 | Murdoch et al. |
| 9,055,805 | B2 | 6/2015 | Koutouras et al. |
| 9,072,385 | B2 | 7/2015 | Gould et al. |
| 9,119,459 | B2 | 9/2015 | Kim et al. |
| 9,138,042 | B2 | 9/2015 | Scicluna |
| 9,200,871 | B2 | 12/2015 | Hexels |
| 9,314,077 | B2 | 4/2016 | Scicluna |
| 9,320,341 | B2 | 4/2016 | Majeau |
| 9,420,871 | B2 | 8/2016 | Roberts |
| D774,750 | S | 12/2016 | Stark |
| 9,585,448 | B2 | 3/2017 | Herold |
| 9,661,904 | B2 | 5/2017 | Yun |
| 9,687,062 | B2 | 6/2017 | Scicluna |
| 9,826,808 | B2 | 11/2017 | Yeh et al. |
| 9,894,972 | B2 | 2/2018 | Davis |
| 10,004,307 | B2 | 6/2018 | Chi Yueh Chen et al. |
| 10,076,166 | B2 | 9/2018 | Kim |
| 2002/0017544 | A1 | 2/2002 | Lee et al. |
| 2002/0104725 | A1 | 8/2002 | Dexheimer |
| 2003/0213821 | A1 | 11/2003 | Oh |
| 2004/0262111 | A1 | 12/2004 | Ghiassi |
| 2005/0156003 | A1 | 7/2005 | Nykoluk |
| 2005/0194413 | A1 | 9/2005 | Marshall |
| 2006/0226180 | A1 | 10/2006 | Hubbell |
| 2007/0175941 | A1 | 8/2007 | Berry et al. |
| 2007/0228091 | A1 | 10/2007 | Shawen |
| 2009/0057360 | A1 | 3/2009 | Demsky |
| 2009/0127299 | A1 | 5/2009 | Jamlang |
| 2009/0139814 | A1 | 6/2009 | Grossman et al. |
| 2009/0229936 | A1 | 9/2009 | Cuong et al. |
| 2010/0236885 | A1 | 9/2010 | Scicluna |
| 2010/0282809 | A1 | 11/2010 | Scicluna |
| 2010/0288591 | A1 | 11/2010 | Drew et al. |
| 2011/0198374 | A1 | 8/2011 | Majeau |
| 2012/0024924 | A1 | 2/2012 | Hexels |
| 2013/0042376 | A1 | 2/2013 | Hexels |
| 2013/0068804 | A1 | 3/2013 | Tweedie |
| 2013/0119104 | A1 | 5/2013 | Graham |
| 2013/0193724 | A1 | 8/2013 | Gould et al. |
| 2013/0206805 | A1 | 8/2013 | Kim et al. |
| 2013/0277407 | A1 | 10/2013 | Murdoch et al. |
| 2014/0116829 | A1 | 5/2014 | Davis |
| 2014/0158737 | A1 | 6/2014 | Koutouras et al. |
| 2014/0251515 | A1 | 9/2014 | Hansen et al. |
| 2015/0083766 | A1 | 3/2015 | Scicluna |
| 2015/0129627 | A1 | 5/2015 | Roberts |
| 2015/0136554 | A1 | 5/2015 | Herold |
| 2015/0320165 | A1 | 11/2015 | Chi Yueh Chen et al. |
| 2016/0302542 | A1 | 10/2016 | Yun |
| 2016/0366995 | A1 | 12/2016 | Yeh et al. |
| 2017/0354218 | A1 | 12/2017 | Kim |

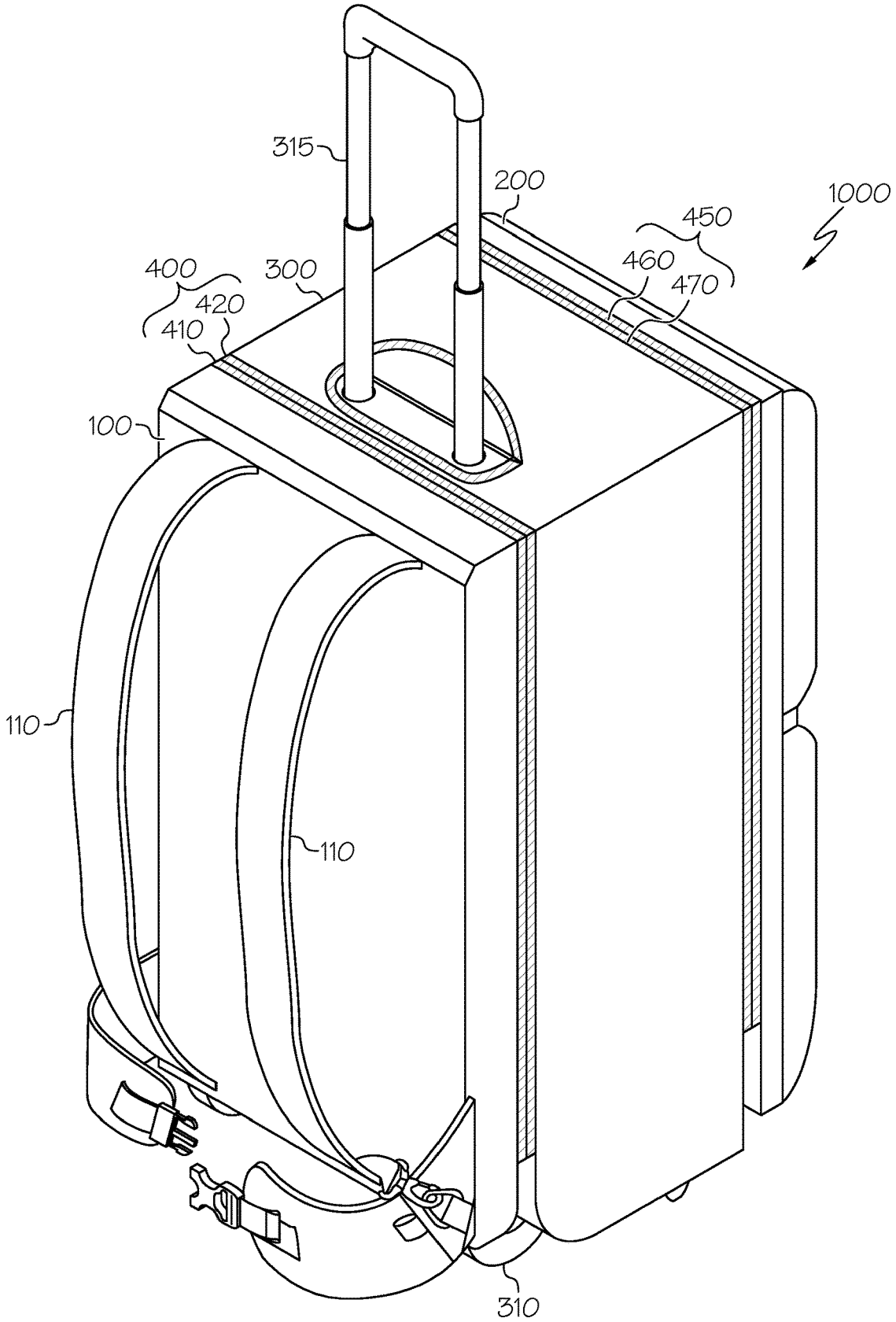
FIG. 1A1

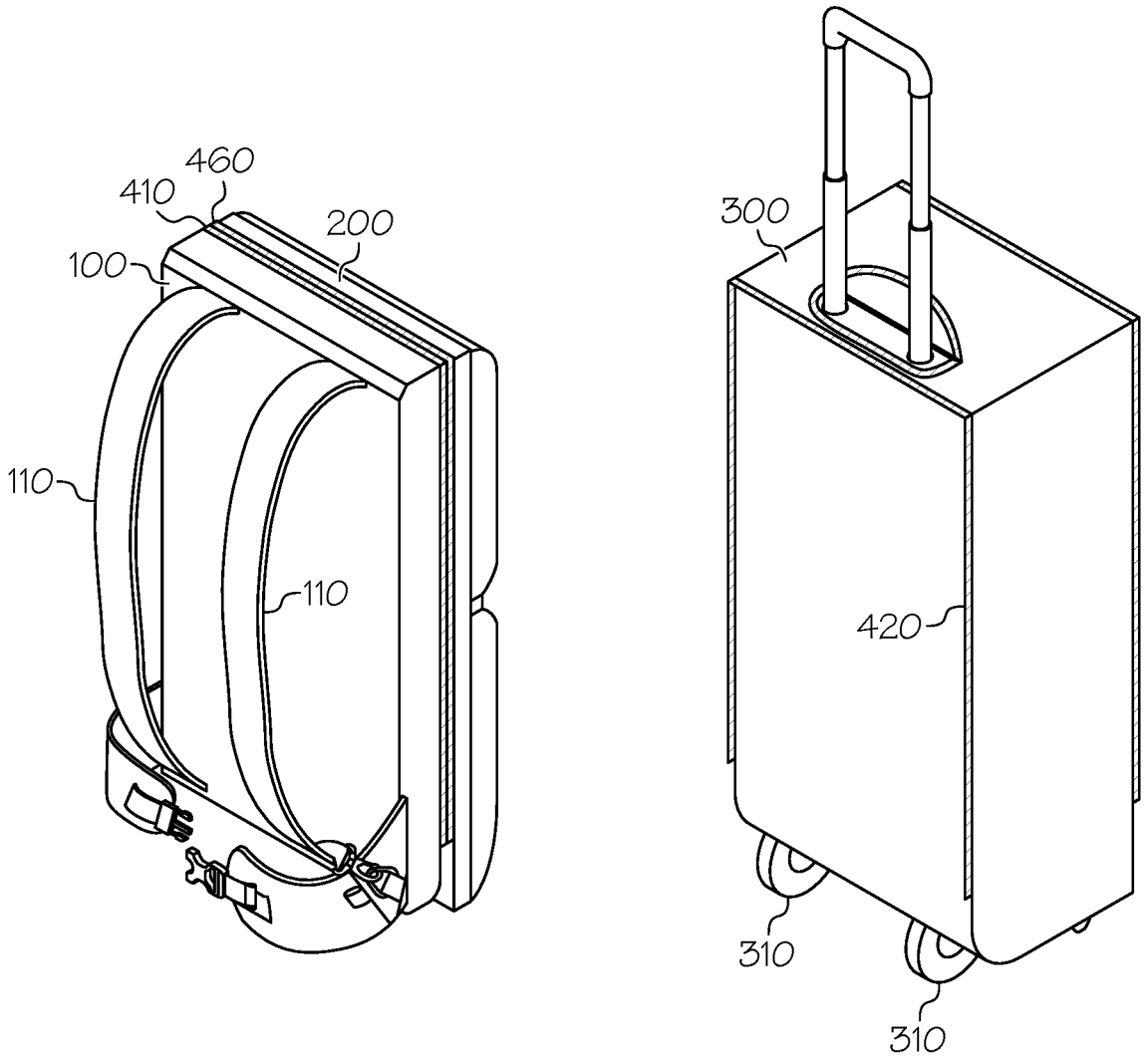
FIG. 1A2

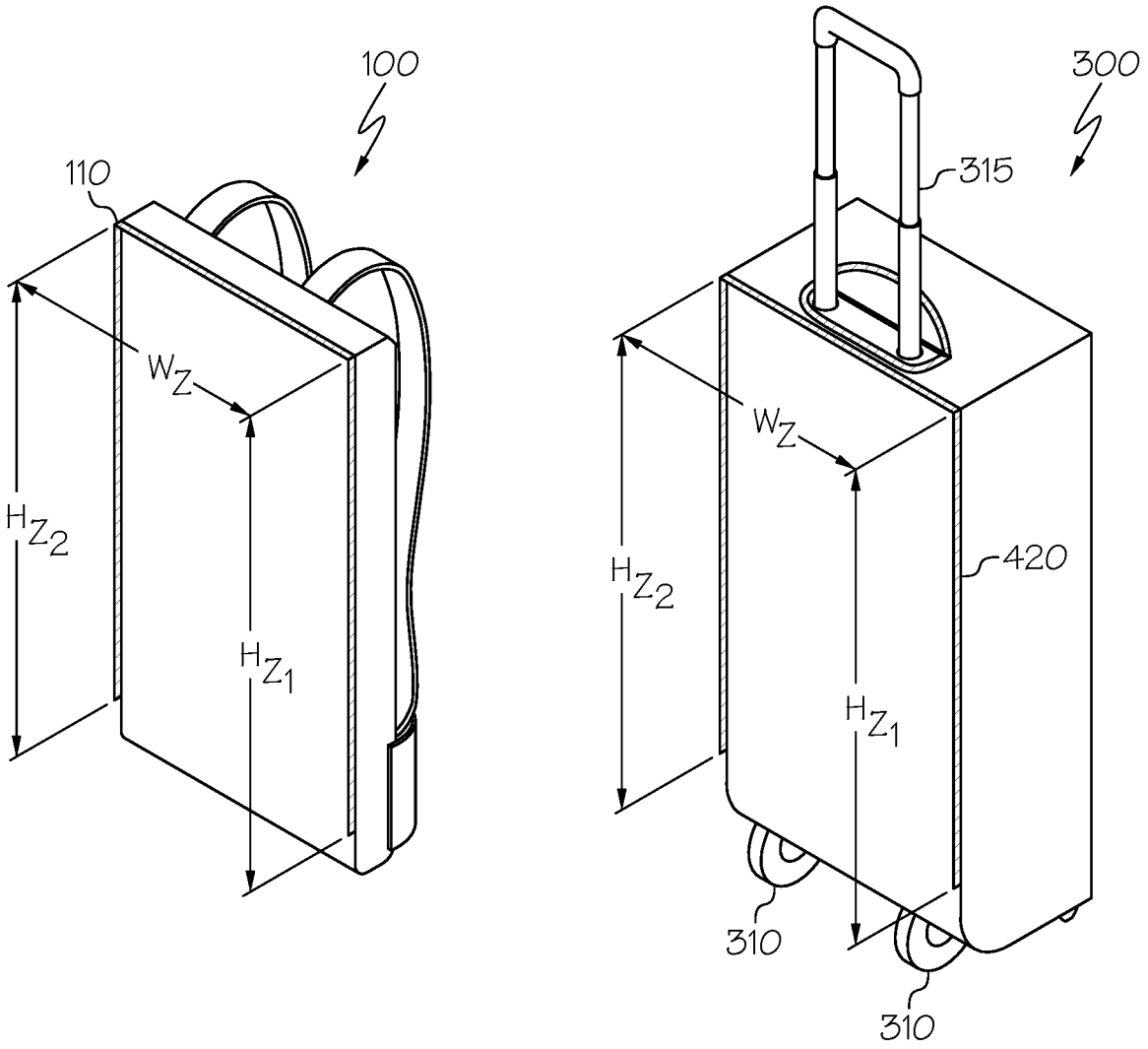
FIG. 1B1

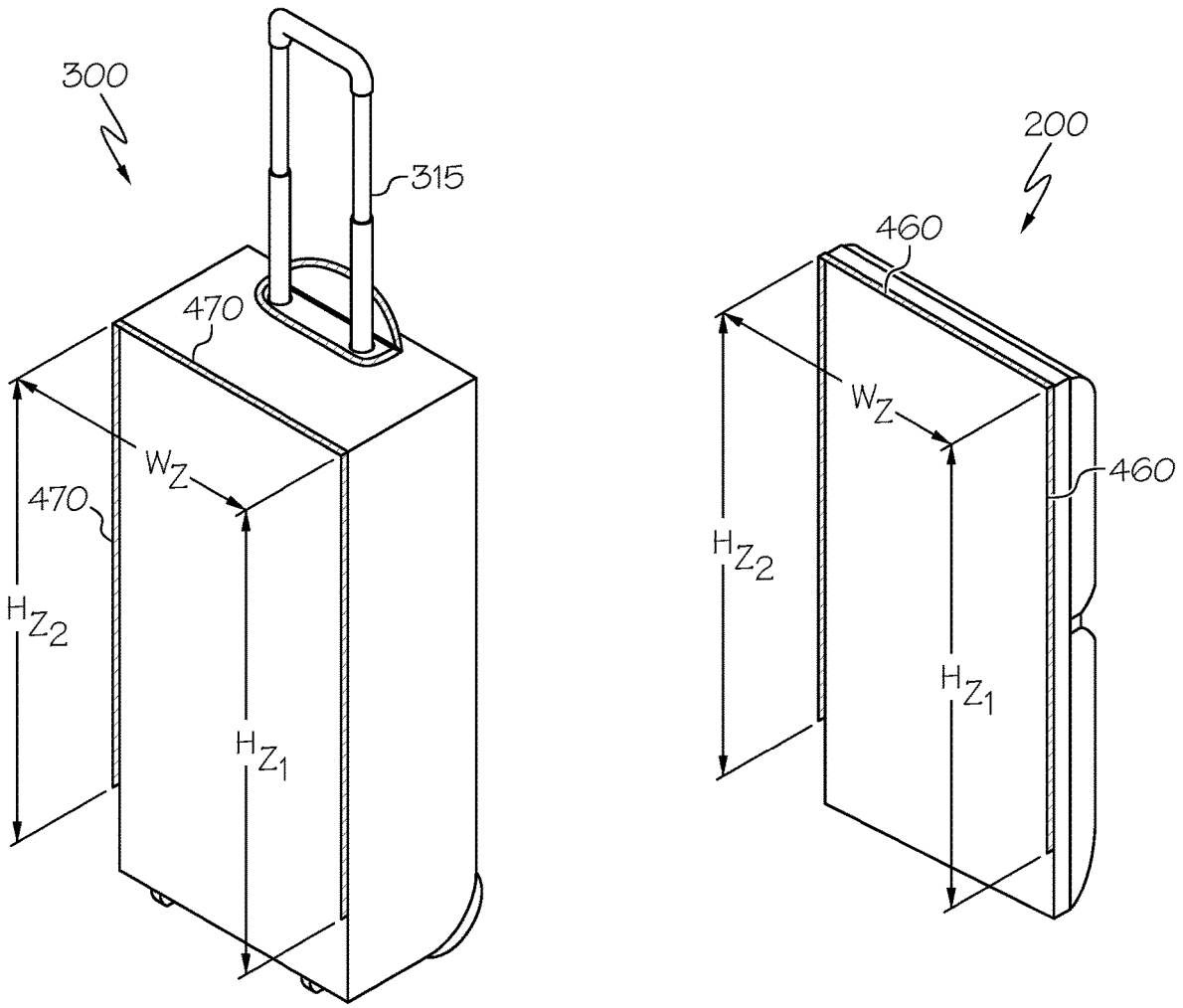
FIG. 1B2

LUGGAGE SYSTEMS

RELATED APPLICATION

This application is a continuation of U.S. patent application Ser. No. 16/102,579, filed on Aug. 13, 2018, which claims the benefit of U.S. Provisional Application No. 62/544,294 filed on Aug. 11, 2017, the content of which is incorporated herein by reference in its entirety.

BACKGROUND

Rolling suitcases that are small enough to carry on many airplanes are commonplace. Some rolling suitcases also have attached shoulder straps so that they can be carried as a backpack. However, these designs have certain limitations.

SUMMARY

Embodiments of the present inventive concepts provide a luggage system that addresses the limitations of the conventional configurations.

In some embodiments, the luggage system can include a removable or detachable portion that can be mounted to a front of a rolling suitcase bag.

In some embodiments, the luggage system can include a removable or detachable portion that can be mounted to a rear of a rolling suitcase bag, opposite the front.

In some embodiments, the removable or detachable portion positioned at the front and/or back can be mounted to a suitcase unit that is not rolling.

In some embodiments, the system can include a checkpoint-friendly configuration per TSA regulations.

In some embodiments, a detachable backpack, briefcase, tote, or similar bag can be included in the system as the removable portion.

In some embodiments, the removable portion can be relatively smaller, and used separately from, and independently of, the larger, suitcase bag, when detached. For example, the removable portion can be taken to meetings or used to carry items when touring a destination location, without having to bring the entire suitcase along.

In some embodiments, a system incorporating the features of the present inventive concepts enables a traveler to travel with only one bag. The system is easier to manage by a traveler—leaving one hand free to attend to other items, or both hands free if the entire system is worn as a backpack In some embodiments, a system incorporating the features of the present inventive concepts allows for passage through TSA security checkpoints in a more traveler-friendly procedure, that can be relatively quicker and easier.

In some embodiments, a system incorporating the features of the present inventive concepts allows for a single bag to be carried and stowed in an airplane, whether under the seat or in an overhead rack, in a manner that is relatively easier and simpler. In some embodiments, the system is configured to qualify as a carry-on bag, in view of United States' requirements for carry-on bags. In some embodiments, the system is configured to qualify as a carry-on bag, in view of international requirements for carry-on bags.

In some embodiments, a system incorporating the features of the present inventive concepts allows for the improvement of the one-bag travel experience for travelers, so that they can travel efficiently with a single, fairly small, carry-on piece of luggage.

As noted above, it would be helpful if the single piece of luggage could be separated at certain points along the journey, so that excursions to meetings or tourist sites could be accomplished in more traveler-friendly fashion, or so that items could be more readily accessed in flight.

In some embodiments, a luggage system is comprised of at least three detachable parts: 1. A "rear unit" or "suspension unit" which may include backpack straps and a compartment which can carry a computer, or a suit, or other fairly flat objects such as files, or may contain a handle or a shoulder strap or both so that when separated it can be carried as a briefcase or tote, 2. A "middle unit" or "suitcase unit" which can carry clothes, toiletries, and/or a variety of other objects, 3. A "front unit", which, among other embodiments, can have quick-access pockets for storing items in an organized manner. The "rear unit" and the "front unit" can be independently attached or unattached to the "middle unit". Once unattached from the "middle unit", the "front unit" and the "back unit" can then be attached together, to form, among other embodiments, a smaller backpack or "daypack", or alternatively, among other embodiments, a briefcase or tote. Alternatively, both the "front unit" and the "back unit" may be used independently (for example, the "back unit" can be used as a slim backpack that is constructed and arranged to carry a computer or other items. In some embodiments, the "front unit" can be constructed and arranged to independently be hung on an airplane seat to provide easy access to items (such as a tablet, book, headphones, etc., for example) during flight.

In some embodiments, a hip-belt can be included on the "suspension unit". In some embodiments, the hip belt can be hidden or folded behind a padded panel designed to make the back of the wearer feel more comfortable when the backpack is worn. This hip-belt can then be pulled out from behind the panel by means of a loop attached to the hip-belt, making it easy to grab while wearing the pack, as opposed to currently available packs requiring a user to remove the pack in order to pull out the hip belt. This "pull out while wearing" feature is further enhanced by a crease in the hip belt on each side of the pack, so that, when the belt is stored, it folds to the correct location for the loop to be easily grabbed and pulled.

In some embodiments, a modular backpack comprises a first body, a second body and a third body. The first body comprises a backpack suspension, a first storage region and a first portion of a first attachment mechanism. The second body comprises a second storage region and a first portion of second attachment mechanism. The third body comprises a third storage region, a second portion of the first attachment mechanism and a second portion of the second attachment mechanism. In a first configuration mode, the first portion of the first attachment mechanism and first portion of the second attachment mechanism mate/couple. In a second configuration mode the first portion of the first attachment mechanism and the second portion of the first attachment mechanism mate/couple; and the first portion of the second attachment mechanism and the second portion of the second attachment mechanism mate/couple.

In some embodiments, a modular system comprises a first body, a second body and a third body. The first body includes a first section, a second section that is TSA compliant, a hinge/access zipper, and a first portion of a first attachment mechanism. The second body includes a second storage region and a first portion of second attachment mechanism. The third body includes a third storage region, a second portion of the first attachment mechanism, and a second portion of the second attachment mechanism. In a first configuration mode, a first portion of the first attachment mechanism and first portion of the second attachment mechanism mate/couple. In a second configuration mode, a first portion of the first attachment mechanism and the second portion of the first attachment mechanism mate/couple; and the first portion of the second attachment mechanism and the second portion of the second attachment mechanism mate/couple.

In some embodiments, a modular system comprises a first body, a second body and a third body. The first body includes a first storage region, a first portion of a first attachment mechanism. The first body has a first height. The second body includes a second storage region, a first portion of a second attachment mechanism. The second body has a second height. The third body includes a third storage region, a second portion of the first attachment mechanism, and a second portion of the second attachment mechanism. The third body is at a third height. In a first configuration mode, the first portion of the first attachment mechanism and first portion of the second attachment mechanism mate/couple. In a second configuration mod, the first portion of the first attachment mechanism and the second portion of the first attachment mechanism mate/couple, and the first portion of the second attachment mechanism and the second portion of the second attachment mechanism mate/couple. The third height is greater than the first height.

In some embodiments, the first height is substantially similar to second height

In some embodiments, a wheel is positioned on an underside of the second body. In some embodiments, a handle extends from the second body.

In some embodiments, a backpack comprises: a first portion, a first exterior having a backpack suspension, and a first interior having a first region. The first region is constructed and arranged to store/hold/confine a laptop. The first region is "TSA compliant", in some embodiments, devoid of metal snaps/zippers/buckles. The second portion includes a second interior that encompasses the first region on a second interior side. A hinge couples the first portion and the second portion. The hinge allows the first portion and the second portion to be opened to at least 180 degrees relative to each other. The second portion further comprises a second exterior side that, in turn, includes an attachment region. The attachment region is substantially planar and includes an attachment mechanism constructed and arranged to receive an additional body.

In some embodiments, the first region includes a laptop pocket. The laptop pocket can include, in various embodiments, a Velcro™ strap (non-metallic), a non-metallic zipper, or a three-sided, envelope, sleeve, pocket, or drawstring.

In some embodiments, the attachment mechanism comprises a zipper, clasps, straps, tension straps, snaps with buttons or Velcro straps.

In some embodiments, the hinge comprises a piece of material or a zipper or other suitable hinge configuration or material.

In some embodiments, an access zipper secures the first portion to the second portion. In some embodiments, the access zipper extends over sides and a top of the backpack In some embodiments, the third body of the system further comprises attachment hooks/straps that are configured to hang the third body on a back of an airplane seat or tray.

In an aspect, a luggage system comprises a first body, comprising: a backpack suspension; a first storage region; and a first portion of a first attachment mechanism. A second body comprises: a second storage region; and a first portion of a second attachment mechanism. A third body comprises: a third storage region; a second portion of the first attachment mechanism; and a second portion of the second attachment mechanism. In a first configuration, the first portion of the first attachment mechanism is coupled to the first portion of the second attachment mechanism. In a second configuration, the first portion of the first attachment mechanism is coupled to the second portion of the first attachment mechanism, and the first portion of the second attachment mechanism is coupled to the second portion of the second attachment mechanism.

In an embodiment, a spatial arrangement of the first portion of the first attachment mechanism matches a spatial arrangement of the first portion of the second attachment mechanism.

In an embodiment, a spatial arrangement of the first portion of the first attachment mechanism matches a spatial arrangement of the second portion of the first attachment mechanism.

In an embodiment, a spatial arrangement of the first portion of the second attachment mechanism matches a spatial arrangement of the second portion of the second attachment mechanism.

In an embodiment, the third body further comprises a front region and a rear region.

In an embodiment, the front region comprises the second portion of the second attachment mechanism.

In an embodiment, the rear region comprises the second portion of the first attachment mechanism.

In an embodiment, the front region and the rear region are positioned at opposite sides of the third body.

In an embodiment, wherein a bottom of the first body is at a first height relative to a lowermost position of the third body.

In an embodiment, a bottom of the second body is at a second height relative to the lowermost position of the third body wherein the first height is substantially similar to the second height.

In an embodiment, the third body comprises at least one wheel.

In an embodiment, the first height is at least half a diameter of the at least one wheel.

In an embodiment, the first height is selected so that the luggage system can roll on the at least one wheel when the first body is tilted 45 degrees.

In an embodiment, the first body further comprises: a first section constructed and arranged to store a computer in a TSA-approved manner such that it may be screened without being removed from the first section; a second section; a hinge that couples a proximal end of the first section to a proximal end of the second section; and an access mechanism that couples the distal end of the first section to the distal end of the second section.

In an embodiment, the hinge of the first body is constructed and arranged to rotate at least 180 degrees.

In an embodiment, the second section of the first body comprises a pocket constructed and arranged to store a computer In an embodiment, the access mechanism comprises a zipper.

In an embodiment, the access mechanism secures the first section to the second section.

In an embodiment, the access mechanism couples the first section to the second section on three sides of the first body.

In an embodiment, the first body further comprises a side pocket.

In an embodiment, the side pocket comprises pleated walls.

In an embodiment, the first body is removably coupled to a first region of the third body.

In an embodiment, the second body is removably coupled to a second region of the third body.

In an embodiment, the first region of the third body is positioned opposite the second region of the first body.

In an embodiment, at least one of the first body, the second body, and the third body comprises at least one foot at a lower portion thereof.

In an embodiment, the at least one foot comprises a half-moon foot.

In an embodiment, the luggage system further comprises at least one compression strap.

In an embodiment, a first length of the at least one compression strap is adjustable.

In an embodiment, the luggage system further comprises at least one compression strap that extends under the third body at at least one side panel thereof.

In an embodiment, the first attachment mechanism comprises a zipper.

In an embodiment, the second attachment mechanism comprises a zipper.

In an embodiment, the first attachment mechanism comprises clips.

In an embodiment, the second attachment mechanism comprises clips.

In an embodiment, the first attachment mechanism comprises straps and buckles.

In an embodiment, the second attachment mechanism comprises straps and buckles.

In an embodiment, the first and second attachment zippers are shorter in length than the first and second access zippers.

In an embodiment, an alignment guide is positioned at a bottom of the first body, the second body, and the third body.

In an embodiment, the backpack suspension comprises at least one shoulder strap.

In an embodiment, the at least one shoulder strap is widest near a top of the first body.

In an embodiment, the at least one shoulder strap comprises a first portion and a second portion, wherein the first portion and the second portion are detachably coupled.

In an embodiment, the at least one of the first portion or the second portion comprises a distal end that is tapered.

In an embodiment, the first body comprises a shoulder strap stowaway compartment.

In an embodiment, the first body is configured as a briefcase.

In an embodiment, the backpack suspension comprises at least one hip strap.

In an embodiment, the backpack suspension further comprises a hip belt between the hip strap and the first storage region.

In an embodiment, the hip belt comprises a foam pad.

In an embodiment, the hip belt comprises at least one crease at which the hip belt can be folded and stored at a hip belt stowaway compartment.

In an embodiment, the hip belt further comprises a finger loop.

In an embodiment, the first body further comprises a foam back support.

In an embodiment, the first body comprises at least one foot.

In an embodiment, the first body comprises a first access mechanism constructed and arranged to allow access to the first storage region.

In an embodiment, the first access mechanism comprises a zipper.

In an embodiment, the zipper comprises a moisture-resistant zipper cover.

In an embodiment, the first body comprises a first expansion mechanism constructed and arranged to expand the first storage region.

In an embodiment, the first expansion mechanism comprises an expansion gusset.

In an embodiment, the first expansion mechanism comprises an expansion zipper.

In an embodiment, the first expansion mechanism comprises a mesh pocket.

In an embodiment, the first body comprises a composite or polyethylene board stiffener.

In an embodiment, the board stiffener comprises a composite material,

In an embodiment, the second body comprises at least one shoulder strap.

In an embodiment, the at least one shoulder strap comprises: a first portion, a proximal end of which is coupled to an upper region of the second body; and a second portion, a proximal end of which is coupled to a lower region of the second body.

In an embodiment, a distal end of the first portion of the at least one shoulder strap further comprises a first strip of one of hook and loop fasteners; and a distal end of the second portion of the at least one shoulder strap further comprises a second strip of the other of hook and loop fasteners.

In an embodiment, the first portion of the at least one shoulder strap has a first width at the proximal end thereof and has a second width at a distal end thereof, the first width being greater than the second width.

In an embodiment, the second body comprises at least one hip strap.

In an embodiment, the second body comprises at least one front pocket

In an embodiment, the at least one front pocket is constructed and arranged to store a clear TSA 3-1-1 bag.

In an embodiment, the second body comprises a compressible pad comprising foam or polyurethane foam.

In an embodiment, the second body comprises at least one hook-and-loop strap.

In an embodiment, the second body comprises at least one hook.

In an embodiment, the at least one hook comprises a composite material, a composite plastic material, or other suitable material.

In an embodiment, the second body comprises at least one pocket constructed and arranged to store the at least one hook.

In an embodiment, the second body further comprises at least one side pocket.

In an embodiment, the at least one side pocket is constructed and arranged to seal content from RFID frequencies.

In an embodiment, the third body comprises at least one wheel.

In an embodiment, the third body comprises at least one handle.

In an embodiment, the at least one handle comprises a retractable handle

In an embodiment, the at least one handle comprises multiple handles positioned at different sides of the third body.

In an embodiment, the at least one handle is positioned at a bottom of the third body.

In an embodiment, the at least one handle is positioned at a top of the third body.

In an embodiment, the at least one handle is positioned at a side of the third body.

In an aspect, a system comprises: a first body, comprising: a backpack suspension; a first storage region; and a first portion of a first attachment mechanism. A second body, comprises: a second storage region; and a first portion of a second attachment mechanism. A third body comprises: a third storage region; a second portion of the first attachment mechanism; and a second portion of the second attachment mechanism. The first body is removably coupled to a first region of the third body by the first attachment mechanism. The second body is removably coupled to a second region of third body, wherein the second region of the third body is opposite the first region of the third body.

In an embodiment, the third body includes a top surface, a bottom surface, a left side surface, a right side surface, a front surface and a rear surface, and wherein the first body is positioned at the rear surface of the third body and the second body is positioned at a front surface of the third body.

In an embodiment, in a first configuration, the first portion of the first attachment mechanism is coupled to the first portion of the second attachment mechanism; and in a second configuration, the first portion of the first attachment mechanism is coupled to the second portion of the first attachment mechanism, and the first portion of the second attachment mechanism is coupled to the second portion of the second attachment mechanism.

In an aspect, a system comprises: a first body comprising: a first storage region; and a first portion of a first attachment mechanism. A second body comprises: a second storage region; and a first portion of second attachment mechanism. A third body comprises: a third storage region; a second portion of the first attachment mechanism; and a second portion of the second attachment mechanism, wherein a bottom of the first body is at a first height relative to a lowermost position of the third body.

In an embodiment, a bottom of the second body is at a second height relative to the lowermost position of the third body wherein the first height is substantially similar to the second height.

In an embodiment, the third body comprises at least one wheel.

In an embodiment, the first height is at least half a diameter of the at least one wheel.

In an embodiment, the first height is selected so that the luggage system can roll on the at least one wheel when the first body is tilted 45 degrees.

In an aspect, a backpack comprises a first portion, comprising: a first exterior, comprising a backpack suspension; and a first interior, comprising a first region constructed and arranged to store a computer in a TSA-approved manner such that it may be screened without being removed from the first region. A second portion comprises: a second interior encompassing the first region on the second interior side; a hinge coupling the first portion and the second portion, the hinge being constructed and arranged to allow the first portion and the second portion to be opened at least 180 degrees relative to each other; and a second exterior side, comprising an attachment region, wherein the attachment region is substantially planar, and wherein the attachment region comprises an attachment mechanism constructed and arranged to receive an additional body.

In an aspect, a bag comprises: a front face; a rear face; a first storage region between the front face and the rear face; an access mechanism constructed and arranged to allow access to the first storage region; a suspension mechanism constructed and arranged to secure the bag to an airplane seat tray; a pocket at the front face, the pocket including a pocket access mechanism constructed and arranged to open a pocket flap to allow access to in inner region of the pocket when the pocket access mechanism is in an open position; and a support mechanism that supports the pocket flap in the open position in a direction that is transverse the front face.

In an embodiment, the suspension mechanism further comprises first and second hooks that extend from the rear face, the hooks dimensioned to interface with an end of an airplane seat tray.

In an embodiment, the suspension mechanism further comprises at least one strap, the at least one strap comprising: a first portion, a proximal end of which is coupled to an upper region of the bag; and a second portion, a proximal end of which is coupled to a lower region of the bag.

In an embodiment, a distal end of the first portion of the at least one strap further comprises a first strip of one of hook and loop fasteners; and a distal end of the second portion of the at least one strap further comprises a second strip of the other of hook and loop fasteners.

In an embodiment, the first portion of the at least one shoulder strap has a first width at the proximal end thereof and has a second width at a distal end thereof, the first width being greater than the second width.

In an embodiment, the access mechanism comprises a zipper.

In an embodiment, the support mechanism comprises at least one strap coupled at a first end to the inner region of the pocket and coupled at a second end to the pocket flap.

BRIEF DESCRIPTION OF THE DRAWINGS

The foregoing and other objects, features and advantages of embodiments of the present inventive concepts will be apparent from the more particular description of embodiments, as illustrated in the accompanying drawings in which like reference characters refer to the same elements throughout the different views. The drawings are not necessarily to scale, emphasis instead being placed upon illustrating the principles of the embodiments.

FIG. 1A1 is a perspective view of an embodiment of a luggage system in accordance with the present inventive concepts.

FIG. 1A2 is a perspective view of an embodiment of a suitcase unit and a daypack unit in accordance with the present inventive concepts.

FIG. 1B1 is a perspective view of an embodiment of the first body and the third body in accordance with the present inventive concepts.

FIG. 1B2 is a perspective view of an embodiment of the second body and the third body in accordance with the present inventive concepts.

FIG. 2 shows a front view of an embodiment of a luggage system in accordance with embodiments of the present inventive concepts.

DETAILED DESCRIPTION

Figure 1:
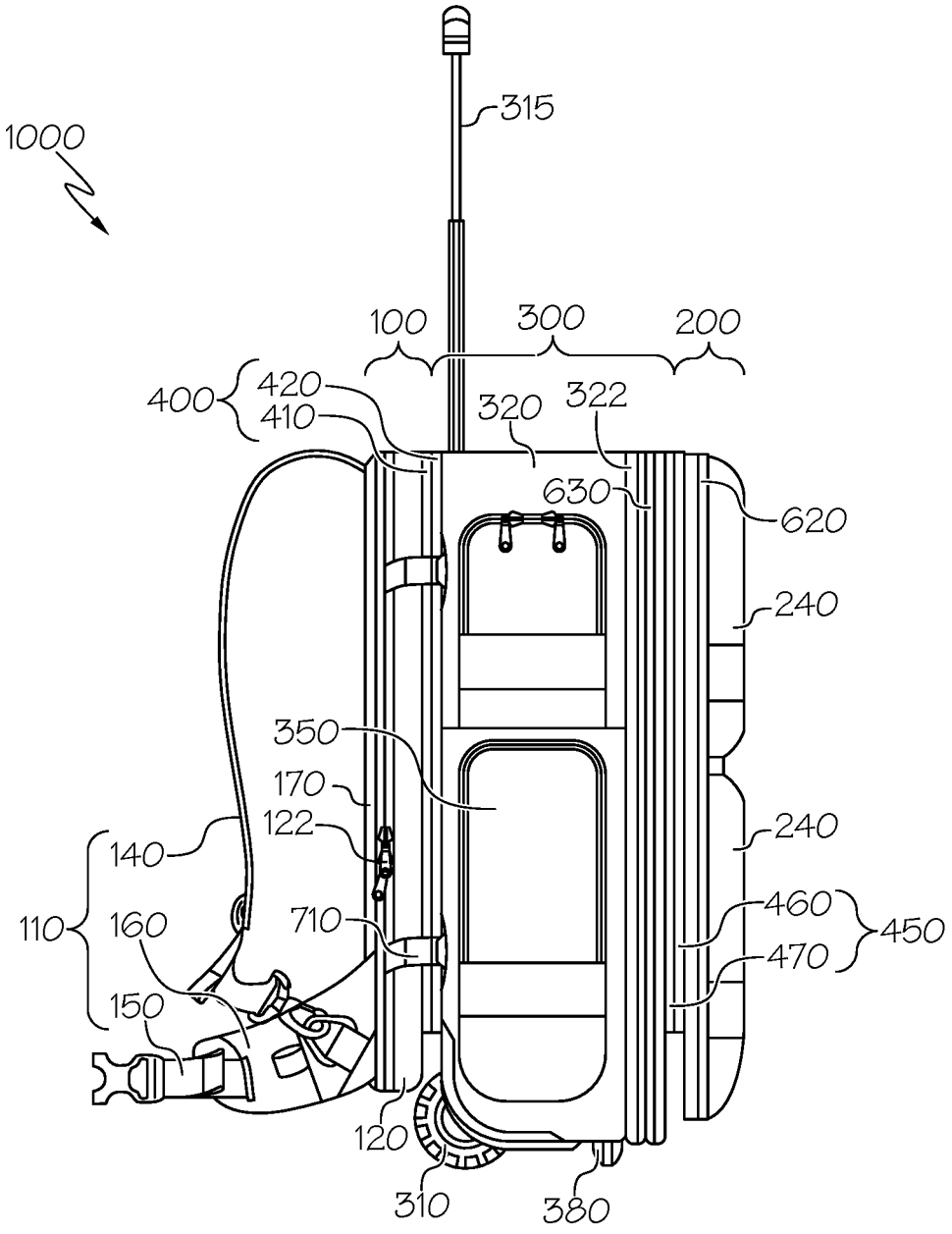
FIG. 1 is a side view of an embodiment of a luggage system in accordance with the present inventive concepts.

Reference will now be made in detail to the present embodiments of the technology, examples of which are illustrated in the accompanying drawings. Similar reference numbers may be used to refer to similar components. However, the description is not intended to limit the present disclosure to particular embodiments, and it should be construed as including various modifications, equivalents, and/or alternatives of the embodiments described herein.

It will be understood that the words "comprising" (and any form of comprising, such as "comprise" and "comprises"), "having" (and any form of having, such as "have" and "has"), "including" (and any form of including, such as "includes" and "include") or "containing" (and any form of containing, such as "contains" and "contain") when used herein, specify the presence of stated features, integers, steps, operations, elements, and/or components, but do not preclude the presence or addition of one or more other features, integers, steps, operations, elements, components, and/or groups thereof.

It will be further understood that, although the terms first, second, third etc. may be used herein to describe various limitations, elements, components, regions, layers and/or sections, these limitations, elements, components, regions, layers and/or sections should not be limited by these terms. These terms are only used to distinguish one limitation, element, component, region, layer or section from another limitation, element, component, region, layer or section. Thus, a first limitation, element, component, region, layer or section discussed below could be termed a second limitation, element, component, region, layer or section without departing from the teachings of the present application.

It will be further understood that when an element is referred to as being "on", "attached", "connected" or "coupled" to another element, it can be directly on or above, or connected or coupled to, the other element, or one or more intervening elements can be present. In contrast, when an element is referred to as being "directly on", "directly attached", "directly connected" or "directly coupled" to another element, there are no intervening elements present. Other words used to describe the relationship between elements should be interpreted in a like fashion (e.g. "between" versus "directly between," "adjacent" versus "directly adjacent," etc.).

It will be further understood that when a first element is referred to as being "in", "on" and/or "within" a second element, the first element can be positioned: within an internal space of the second element, within a portion of the second element (e.g. within a wall of the second element); positioned on an external and/or internal surface of the second element; and combinations of one or more of these.

As used herein, the term "proximate" shall include locations relatively close to, on, in and/or within a referenced component, anatomical location, or other location.

Spatially relative terms, such as "beneath," "below," "lower," "above," "upper" and the like may be used to describe an element and/or feature's relationship to another element(s) and/or feature(s) as, for example, illustrated in the figures. It will be further understood that the spatially relative terms are intended to encompass different orientations of the device in use and/or operation in addition to the orientation depicted in the figures. For example, if the device in a figure is turned over, elements described as "below" and/or "beneath" other elements or features would then be oriented "above" the other elements or features. The device can be otherwise oriented (e.g. rotated 90 degrees or at other orientations) and the spatially relative descriptors used herein interpreted accordingly.

The terms "reduce", "reducing", "reduction" and the like, where used herein, are to include a reduction in a quantity, including a reduction to zero. Reducing the likelihood of an occurrence shall include prevention of the occurrence.

The term "and/or" where used herein is to be taken as specific disclosure of each of the two specified features or components with or without the other. For example, "A and/or B" is to be taken as specific disclosure of each of (i) A, (ii) B and (iii) A and B, just as if each is set out individually herein.

In this specification, unless explicitly stated otherwise, "and" can mean "or," and "or" can mean "and." For example, if a feature is described as having A, B, or C, the feature can have A, B, and C, or any combination of A, B, and C. Similarly, if a feature is described as having A, B, and C, the feature can have only one or two of A, B, or C.

The expression "configured (or set) to" used in the present disclosure may be used interchangeably with, for example, the expressions "suitable for", "having the capacity to", "designed to", "adapted to", "made to" and "capable of" according to a situation. The expression "configured (or set) to" does not mean only "specifically designed to" in hardware. Alternatively, in some situations, the expression "a device configured to" may mean that the device "can" operate together with another device or component.

It is appreciated that certain features of the disclosure, which are, for clarity, described in the context of separate embodiments, may also be provided in combination in a single embodiment. Conversely, various features of the disclosure which are, for brevity, described in the context of a single embodiment, may also be provided separately or in any suitable sub-combination. For example, it will be appreciated that all features set out in any of the claims (whether independent or dependent) can be combined in any given way.

It is to be understood that at least some of the figures and descriptions of the disclosure have been simplified to focus on elements that are relevant for a clear understanding of the disclosure, while eliminating, for purposes of clarity, other elements that those of ordinary skill in the art will appreciate may also comprise a portion of the disclosure. However, because such elements are well known in the art, and because they do not necessarily facilitate a better understanding of the disclosure, a description of such elements is not provided herein.

Terms defined in the present disclosure are only used for describing specific embodiments of the present disclosure and are not intended to limit the scope of the present disclosure. Terms provided in singular forms are intended to include plural forms as well, unless the context clearly indicates otherwise. All of the terms used herein, including technical or scientific terms, have the same meanings as those generally understood by an ordinary person skilled in the related art, unless otherwise defined herein. Terms defined in a generally used dictionary should be interpreted as having meanings that are the same as or similar to the contextual meanings of the relevant technology and should not be interpreted as having ideal or exaggerated meanings, unless expressly so defined herein. In some cases, terms defined in the present disclosure should not be interpreted to exclude the embodiments of the present disclosure.

FIG. 1 is a side view of an embodiment of a luggage system 1000 in accordance with the present inventive concepts. In the embodiment shown in FIG. 1, the luggage system 1000 comprises a first body 100, a second body 200, and a third body 300. The first body 100 may also be referred herein to as a suspension unit or a rear unit. The second body 200 may also be referred to herein as a front unit. The third body 300 may also be referred to as a suitcase unit.

In some embodiments, the first body 100 is removably coupled to a rear region of the third body 300 via a first attachment mechanism 400. In some embodiments, the second body 200 is removably coupled to a front region of the third body 300 via a second attachment mechanism 450. In some embodiments, the front region and the rear region are positioned on opposite sides of the third body 300.

In the embodiment shown in FIG. 1, the first body 100 comprises a backpack suspension 110, a first storage region 120, and a first portion 410 of a first attachment mechanism 400. In the embodiment shown in FIG. 1, the first body 100 is configured as a backpack, with the backpack suspension 110 comprising at least one shoulder strap 140, a hip strap 150, and a hip belt 160. In the embodiment shown in FIG. 1, the first storage region 120 can be opened and/or closed, and/or otherwise accessed, with a first access zipper 122. In other embodiments, the first storage region 120 can be opened and/or closed, and/or otherwise accessed, using other types of access mechanisms including, but not limited to, clasps, levers, straps, or buttons.

In some embodiments, the second body 200 comprises a second storage region 220 (not shown in FIG. 1) and a first portion 460 of a second attachment mechanism 450. In some embodiments, the second storage region 220 can be opened and/or closed, and/or otherwise accessed, with a second access zipper 222 (not shown in FIG. 1—see FIG. 3). In other embodiments, the second storage region 220 can be opened and/or closed, and/or otherwise accessed, with other mechanisms including, but not limited to, clasps, levers, straps, or buttons. In some embodiments, the second body 200 can take various configurations, including optional attached or detachable features such as pockets, straps for hanging or attaching the second body 200 to other objects, detachable travel totes or purses, etc. in other embodiments, the second body 200 may comprise components of a backpack specialized for carrying specific equipment, such as photography equipment, sports equipment such as skateboards or tennis rackets, infant-care equipment such as diapers and feeding bottles, or other customer-specific needs.

In some embodiments, the third body 300 comprises a third storage region 320, a second portion 420 of the first attachment mechanism 400, and a second portion 470 of the second attachment mechanism 450. In the embodiment shown in FIG. 1, the third body 300 is configured as a rolling suitcase, comprising at least one wheel 310 and at least one handle 315. In some embodiments, the third body 300 does not comprise any wheels. In some embodiments, the third body 300 comprises a different number of wheels 310 than the embodiment shown in FIG. 1. In some embodiments, the third body 300 comprises wheels 310 at one side of the third body 300, so that the rolling suitcase can be pitched at an angle using the handle 315 and rolled. In some embodiments, the third body 300 comprises wheels 310 at one side of a lower portion of the third body 300, for example two wheels coupled to the third body with horizontal axles, and feet 380 at the other side of the lower portion, so that the rolling suitcase can be pitched at an angle using the handle 315 to operate in a rolling mode, or rested on its feet 380 in a stationary mode. In some embodiments, the third body 300 comprises wheels 310 at both sides of the third body 300, for example four pivoting wheels coupled to the third body 300 vertical axles, so that the rolling suitcase can be freely rolled in any direction using the handle 315.

The at least one handle 315 may be retractable. In some embodiments, the at least one handle 315 may extend and retract by way of a telescoping mechanism. In some embodiments, the third body 300 is absent a handle. In some embodiments, the at least one handle 315 is fixed and non-retractable. In some embodiments, the third body 300 comprises handles 315 positioned at side portions of the third body 300, for example at opposite side portions. In some embodiments, an access cover is provided to cover the at least one handle 315, when retracted. In such an embodiment, the access cover is comprises a zipper or similar access mechanism for accessing the handle 315.

In the embodiment depicted in FIG. 1, the third storage region 320 can be opened and/or closed, and/or otherwise accessed, with a third access zipper 322. In other embodiments, the third storage region 320 can be opened and/or closed, and/or otherwise accessed, using other types of access mechanisms including, but not limited to, clasps, levers, straps, or buttons.

In the embodiment shown in FIG. 1, the first portion of the first attachment mechanism 410 of the first body 100 is coupled to the second portion of the first attachment mechanism 420 of the third body 300. In the embodiment shown in FIG. 1, the first portion of the second attachment mechanism 460 of the second body 200 is coupled to the second portion of the second attachment mechanism 470 of the third body 300.

In the embodiment shown in FIG. 1, the first body 100 and the second body 200 are attached to the third body 300 by attachment mechanisms 400, 450, for example in the form of attachment zippers. In some embodiments, the attachment zippers are designed to be the same size and attached in the same shape to both the first body 100 and the second body 200. In other embodiments, first 100 and second 200 bodies could also be attached to each other by other types of attachment mechanisms, such as Velcro, clips, straps, hooks, bands with elastic properties, or other types of fasteners or attachment mechanisms.

By configuring the first and second attachment mechanisms 400, 450 to be the same size, shape or length, a modular system can be provided. In the embodiment shown in the side view of FIG. 1, and, further referring to the perspective views of FIGS. 1A1 and 1A2, a front portion of a backpack in the form of body 200, can be separated from the system 1000, in this case, separated from the third body 300 of the system 1000, by separating the second attachment mechanism 450. Similarly, a rear portion of a backpack, in the form of body 100, can likewise be separated from the system, in this case, separated from the third body 300 of the system 1000 by separating the second attachment mechanism 400.

Figure 2:
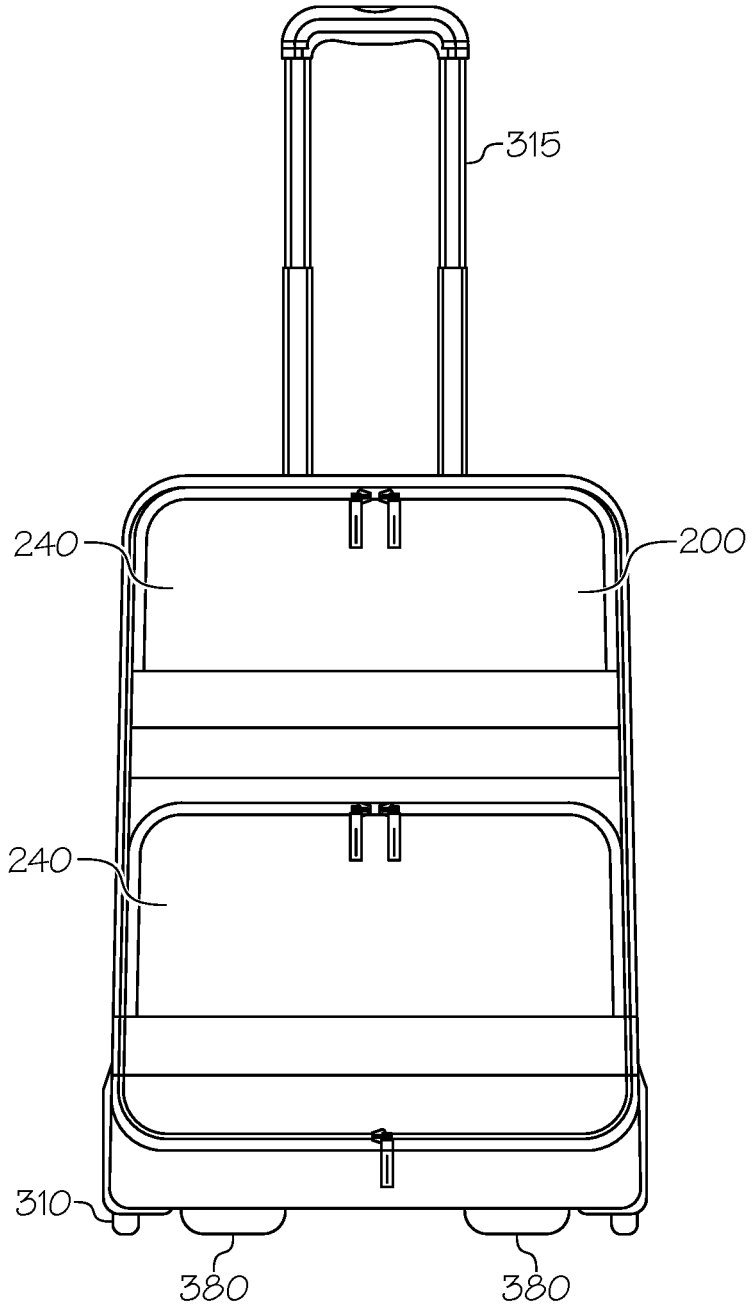

Once separated, the first body 100 can be coupled directly to the second body 200. In particular, the first portion 410 of the first attachment mechanism 400 is configured to couple to the first portion 460 of the second attachment mechanism 450. In a case where the first and second attachment mechanisms 400, 450 comprise zippers, the first portion 410 of the first attachment mechanism 400 may include a zipper slider and zipper retainer box, while the second portion 420 of the first attachment mechanism 400 may include a zipper pin that mates with the zipper slider and zipper retainer box of the first portion 410 of the first attachment mechanism 400. Similarly, the first portion 460 of the second attachment mechanism 450 may include a zipper pin, while the second portion 470 of the second attachment mechanism 450 may include a mating zipper slider and zipper retainer box that corresponds to the first portion 460 of the second attachment mechanism 450. As shown in FIG. 1A2, as a result, the first body 100 can be coupled directly to the second body 200. In this example, the coupled first body 100 and second body 200 provide a daypack configuration, with the first body 100 providing the utility of a full suspension 110 along with a first pack volume at the first storage region 120, and with the second body 200 providing a second pack volume at the second storage region 220.

To accommodate this arrangement, the geometries of the first and second portions 410, 420 of the first attachment mechanism 400 and the geometries of the first and second portions 460, 470 of the second attachment mechanism 450 are arranged to match. In the case of the first and second attachment mechanisms being in the form of zippers, the matching zippers can be configured to have corresponding positional geometries, corresponding lengths, mating zipper teeth, and the like.

In some embodiments, the zipper tape of each of the first and second portions 410, 420, 460, 470 is coupled to portions of respective bodies 100, 200, 300 so that the zipper teeth extend in a direction away from the body 100, 200, 300 to which it is coupled, for mating with zipper teeth of a corresponding portion of a corresponding body 100, 200, 300. In some embodiments the zipper tape is coupled to the body 100, 200, 300 so that the zipper teeth extend in a direction that is substantially perpendicular to the body 100, 200, 300.

FIGS. 1B1 and 1B2 are perspective views of examples of matching zipper geometries for the first and second portions 410, 420 of the first attachment mechanism 400 and the first and second portions 460, 470 of the second attachment mechanism 450 in accordance with an embodiment of the present inventive concepts. In this example embodiment, the zippers of each of the first and second attachment mechanisms 400, 450 comprise a single zipper. The first and second portions 410, 420 of the first attachment mechanism 400 and the first and second portions 460, 470 of the second attachment mechanism 450 are coupled to the respective bodies in a generally arched-shaped, or upside-down-U-shaped, configuration. The right-side legs of each zipper portion 410, 420, 460, 470 have the same height Hz1 and the left-side legs of each portion 410, 420, 460, 470 have the same height Hz2. In some embodiments, the heights of the right-side legs Hz1 and the heights of the left-side legs Hz2 are in turn equal to each other, i.e., Hz1=Hz2. In addition, the horizontal portions of each zipper portion 410, 420, 460, 470 have the same width Wz.

By configuring the portions 410, 420, 460, 470 of the attachment mechanisms 400, 450 to have similar geometries, the first and second bodies 100, 200 can be separated from the third body 300 and re-attached to each other, as shown in FIG. 1A2.

Other configurations of the attachment mechanisms are equally applicable to the principles of the present inventive concepts.

Figure 1C:
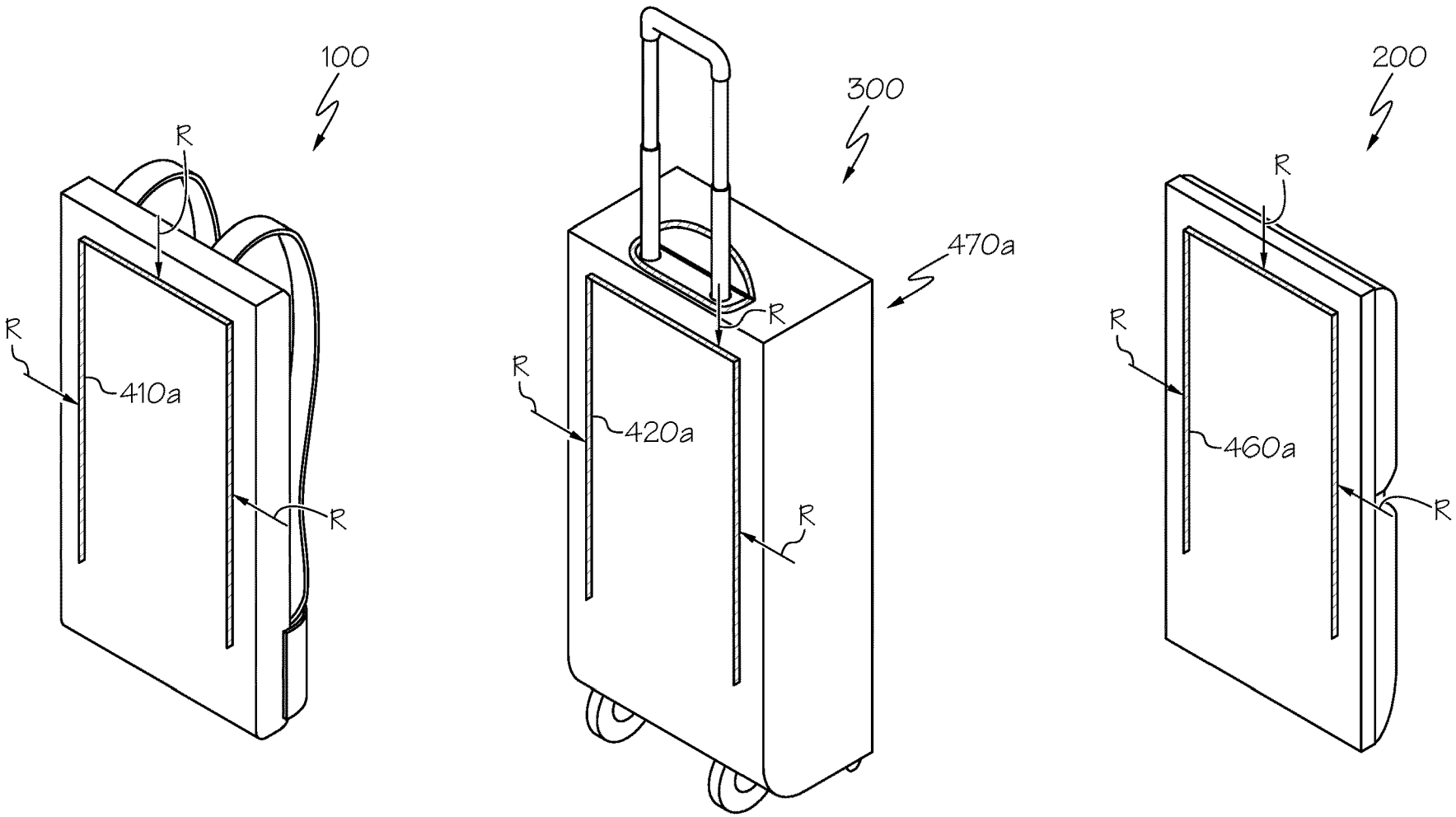
FIG. 1C is a perspective view of an embodiment of the first body, second body, and third body in accordance with the present inventive concepts.

With reference to the perspective view of FIG. 1C, in this embodiment, the zipper portions 410*a*, 420*a*, 460*a*, 470*a* are coupled at a position that is recessed relative to a sidewall of the respective body 100, 200, 300 by a recess amount R. This configuration can operate to protect the coupled zipper from interference.

Figure 1D:
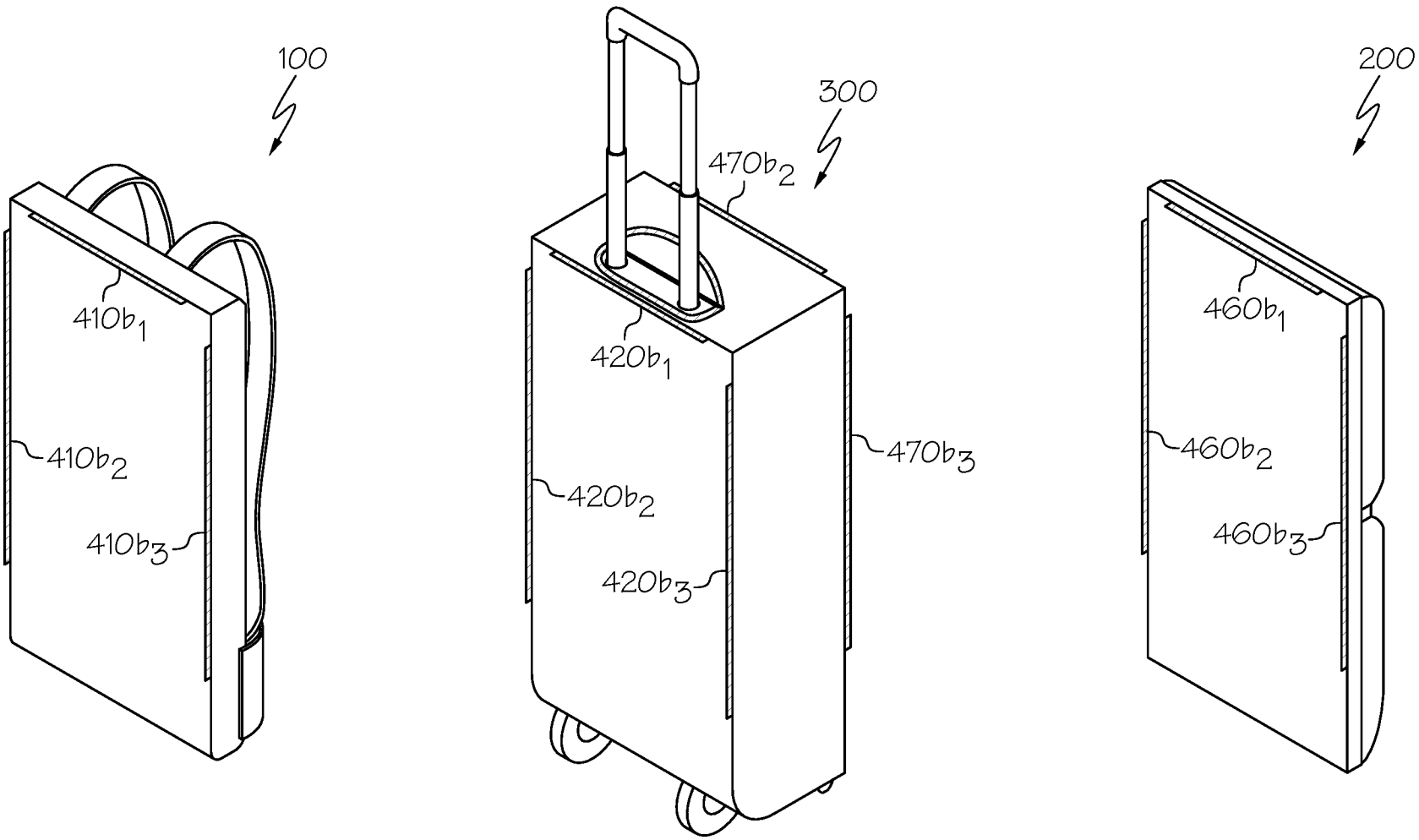
FIG. 1D is a perspective view of an embodiment of the first body, second body, and third body in accordance with the present inventive concepts.

With reference to the perspective view of FIG. 1D, in this embodiment, the zipper portions 410*b*, 420*b*, 460*b*, 470*b* are coupled at a position that is at or near a sidewall of the respective body 100, 200, 300, as in the embodiment of FIG. 1B. However, in the present embodiment, the zipper portions 410*b*, 420*b*, 460*b*, 470*b* each comprise three sub-portions 410*b*1, 410*b*2, 410*b*3; 420*b*1, 420*b*2, 420*b*3; 460*b*1, 460*b*2, 460*b*3; 470*b*1, 470*b*2, 470*b*3. The geometry and positioning of the three sub-portions match each other as described herein.

Figure 1E:
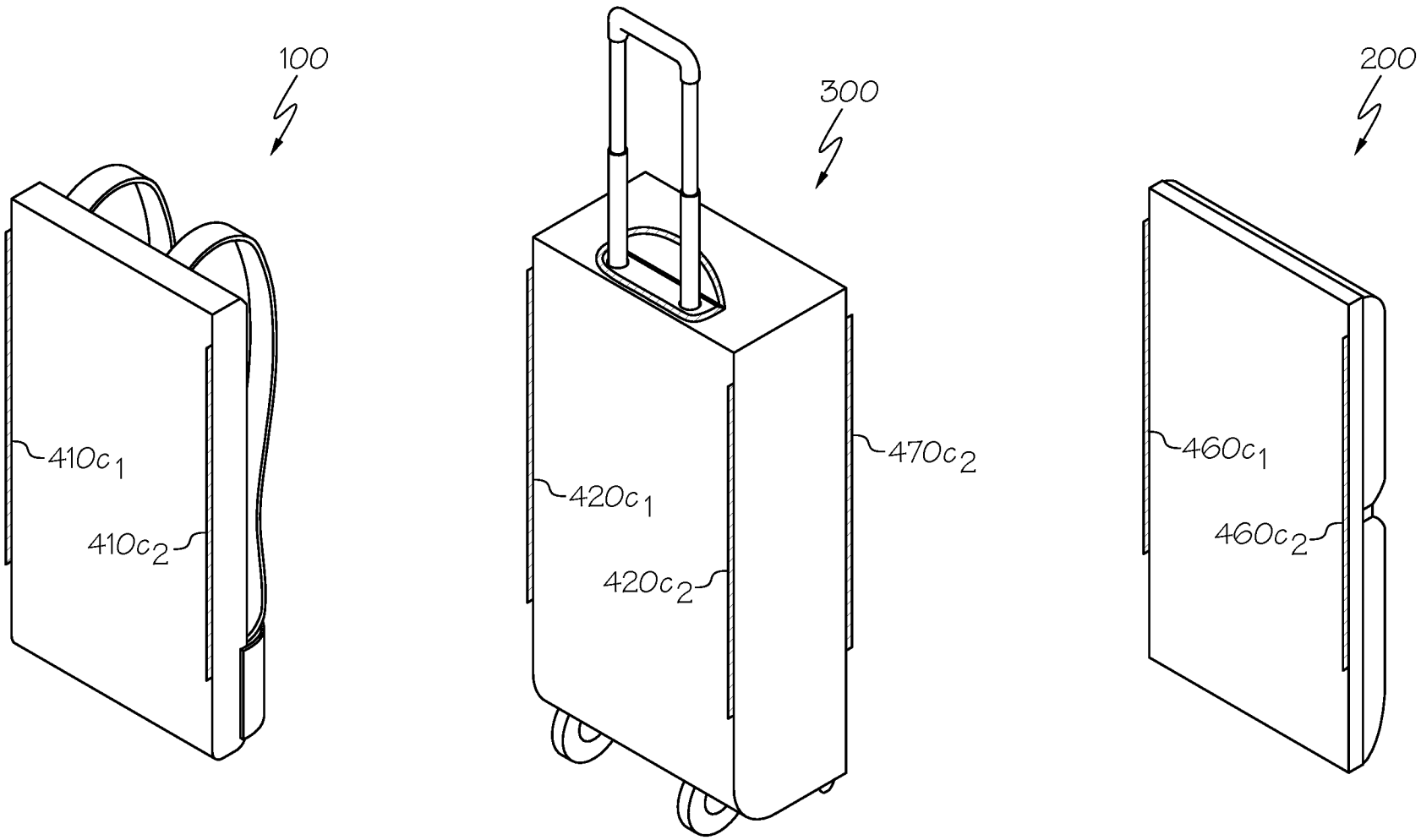
FIG. 1E is a perspective view of an embodiment of the first body, second body, and third body in accordance with the present inventive concepts.

With reference to the perspective view of FIG. 1E, in this embodiment, the zipper portions 410*b*, 420*b*, 460*b*, 470*b* are coupled at a position that is at or near a sidewall of the respective body 100, 200, 300, as in the embodiment of FIG. 1B. However, in the present embodiment, the zipper portions 410*b*, 420*b*, 460*b*, 470*b* each comprise two sub-portions 410*c*1, 410*c*2; 420*c*1, 420*c*2; 460*c*1, 460*c*2; 470*c*1, 470*c*2. The geometry and positioning of the two sub-portions match each other as described herein.

As described herein, the front 200 and back 100 units can each be independently attached to the suitcase unit 300, creating an integrated unit that can be carried as a single piece, for example carried by the suspension 110 as a single piece. Alternatively, the front 200 and back 100 units can be separated from the suitcase unit 300 and joined together by the first portion 410 of the first attachment mechanism 400 and the first portion 460 of the second attachment mechanism 450 create a backpack, which can be used and worn independent of the suitcase unit 300, as described herein at least in connection with the embodiments of FIGS. 1A2 and 5-7. Note also that both the front unit 200 and the back unit 100 could also be used independently of each other, so that the system can be deployed as three separate, functional units 100, 200, 300, for example as illustrated at least in the embodiments of FIGS. 1B, 1C, 1D, 1E.

In other embodiments, attachment mechanisms 400, 450 other than zippers can be employed. For example attachment mechanisms 400, 450 in the form of such as clasps, levers, straps, and the like, or other suitable mechanisms for removably coupling the first, second and third bodies 100, 200, 300 can be employed. In such a configuration, by configuring the positions of the mating attachment mechanisms 400, 450 to be of the same configuration, geometry, and/or position for each portion, a modular system can be provided.

Returning to the embodiment of FIG. 1, the rolling system 1000 can operated to be rolled as a rolling bag. In the rolling mode, the shoulder straps 140 and hip belt 150, 160 of the suspension 110 can be stowed at or behind a back panel 170 of the first body 100. Alternatively, the system 1000 in its entirety can be worn as a backpack, with both the suspension unit 100 and the front unit 200 attached to the third body, or suitcase unit 300. Note that, in this particular embodiment, both the front unit 200 and the suitcase unit 300 comprise an expansion mechanism 620, 630 and are expandable. In some embodiments, the first body 100 also comprises an expansion mechanism. In some embodiments, the expansion mechanism may comprise at least one expansion zipper. In some embodiments, the front unit 200 comprises a second expansion zipper 620 (not shown in FIG. 1, see for example, FIG. 9). In some embodiments, the suitcase unit 300 comprises a third expansion zipper 630 (Not shown in FIG. 1, see for example, FIG. 9). Each expansion zipper 620, 630, when unzipped, releases an expansion gusset, which affords a user access to additional storage volume within the corresponding body 100, 200, 300.

In the embodiment depicted in FIG. 1, the third body 300 comprises at least two side pockets 350 positioned above each other in a vertical direction. In the present embodiment, the side pockets 350 are rectangular in shape. In other embodiments, the side pockets 350 may comprise shapes other than rectangular shapes. In some embodiments, the side pockets may comprise pleated side walls constructed and arranged to expand to accommodate additional storage volume.

In some embodiments, the back panel 170 may comprise a polyurethane (PU) foam insert. In other embodiments, the back panel 170 may comprise another suitable foam, synthetic, or natural material. The thickness of the back panel may be selected based on desired comfort or desired profile. In some embodiments, the shoulder straps 140 may be detached from the hip strap 160 or hip belt 150, and the entire suspension 110 can be tucked behind the back panel 170 at pockets 142 and hip belt passage 165 (see FIG. 19)

Figure 11:
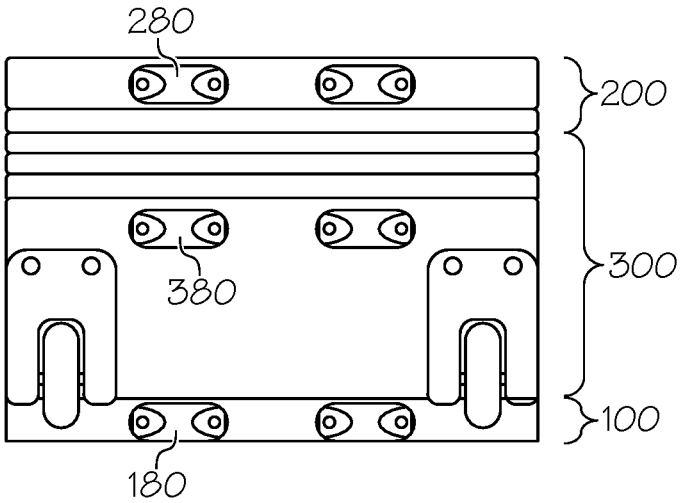
FIG. 11 is a bottom view of an embodiment of a luggage system in accordance with the present inventive concepts.

In the embodiment depicted in FIG. 1, the third body 300 comprises at least one foot 380. In some embodiments, the foot 380 may be shaped or configured in the shape of a "half-moon". In some embodiments, the first body 100 comprises a foot 180, as shown in FIG. 11. In some embodiments, the second body comprises a foot 280, as shown in FIG. 11. In some embodiments, the feet from different bodies are aligned along a first horizontal axis of the system 1000. In some embodiments, the feet from different bodies are aligned along a second horizontal axis.

In the embodiment of FIG. 1, the first body 100 comprises at least two compression straps 710. In other embodiments, the first body 100 may comprise at least one compression strap 710. In FIG. 1, the compression strap 710 extends behind the side pockets 350 of the third body 300. In some embodiments, the compression straps 710 are constructed and arranged to apply a compressive force on the first storage region 120 of the first body 100 and/or on the second storage region 220 of the second body 200.

In some embodiments, one or more zippers of the first body 100 are covered with a zipper cover. In some embodiments, one or more zippers of the second body 200 are covered with a zipper cover. In some embodiments, one or more zippers of the third body are covered with a zipper cover. In various embodiments, such zipper covers can operate to resist incidental water from entering the interior of the system through the zipper. In some embodiments, the luggage system 1000 comprises access mechanisms with water resistant shielding. In some embodiments, the luggage system 1000 comprises regions with bar-tack reinforcement to provide for increased durability.

In other embodiments, the first body 100 or second body 200 may be configured as a briefcase. In some embodiments, the first body 100 or second body 200 may be configured as a tote. In some embodiments, the first body 100 or second body 200 is configured as another type of bag or luggage.

FIG. 2 is a front view of an embodiment of a luggage system 1000 in accordance with embodiments of the present inventive concepts. In the embodiment shown in FIG. 2, the second body 200 comprises one or more front pockets 240 for storing items. In the embodiment shown, the pockets comprise multiple front pockets positioned above each other in a vertical direction. In the embodiment shown, the front pockets 240 are secured with zippers. In other embodiments, the front pockets 240 may be secured by other means such as buttons, Velcro, clips, straps, hooks, bands with elastic properties, or other types of fasteners or attachment mechanisms. In some embodiments, the front pockets 240 comprise pockets constructed and arranged to help a user organize electronic devices and other items. In some embodiments, the front pockets 240 comprise an RFID protection liner configured to inhibit RFID signals from penetrating the system 1000. In some embodiments at least one of the front pockets 240 may comprise multiple zippers (lower front pocket in FIG. 2). Multiple zippers (or other access mechanisms) allow the user easier access to the content of a pocket. In some embodiments, the width of the luggage system 1000 tapers inwardly in an upward direction, with the widest region being closest to the bottom of the system 1000. In some embodiments, each body in the luggage system 1000 tapers at approximately the same angle or degree to provide for a more attractive appearance.

Figure 3:
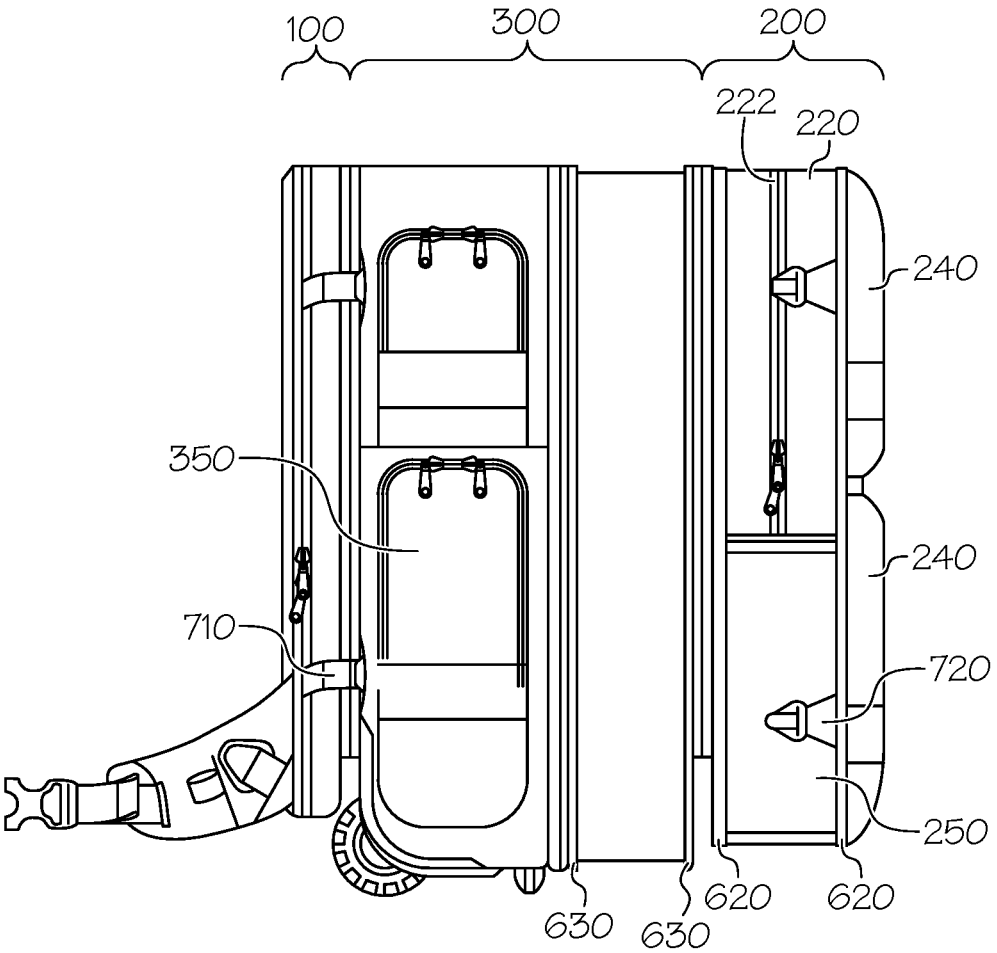
FIG. 3 is a side view of an embodiment of a luggage system in accordance with the present inventive concepts.

FIG. 3 is a side view of an embodiment of a luggage system 1000 in accordance with the present inventive concepts. FIG. 3 depicts both the suitcase unit 300 and the front unit 200 in an expanded state, as a result of the respective expansion zippers 620, 630 being opened. In the present embodiment, both the front unit 200 and the suspension unit 100 include compression straps 710, 720. When the suspension unit 100 is affixed to the suitcase unit 300, the compression straps 710 connect with a buckle or similar connector to straps in turn coupled to the suitcase unit 300. The compression strap system provides extra strength or tension to the overall luggage system 100. The rear unit 100 is connected to the suitcase unit 300 by both the attachment mechanism 400 and the straps 710. In another mode of operation, when the rear unit 100 is detached from the suitcase unit 300 and attached to front unit 200, these mating straps 710, 720 operate as compression straps for the resulting daypack itself, and allow the expansion cavity of the first body 100 or second body 200 to be compressed, or otherwise retracted, to the desired volume.

As described herein, optional zippered side pockets 350 can be positioned on the suitcase unit 300. The side pockets 350 can be configured to store a variety of items. Optional front "quick access" pockets 240 at the outer face of the front unit 200, can be configured with helpful organizational compartments for storage and/or positioning of various items, including, for example, cell phones, battery chargers, umbrellas, sunglasses, iPads or other tablet devices, etc. In addition, wheels for rolling the suitcase unit 300, rear unit 100 or front unit may optionally be stored in the pockets 240, 350.

In some embodiments, the second body 200 comprises a second access mechanism 222 that provides access to the second storage region 220. In the embodiment shown in FIG. 3, the second access mechanism 222 comprises a zipper. In other embodiments, the second storage region 220 can be opened and/or closed with other access mechanisms including, but not limited to, clasps, levers, straps, and buttons. In some embodiments, the second body 200 comprises at least one side pocket 250. In some embodiments, the at least one side pocket 250 of the second body 200 is exposed when the second expansion zipper 620 of the second body 200 is open and in an expanded mode. In some embodiments, the side pocket 250 comprises an expandable mesh fabric having an elastic top portion. In this manner, the side pocket 250 can operate, for example, as a bottle holder or umbrella pocket.

Figure 4A:
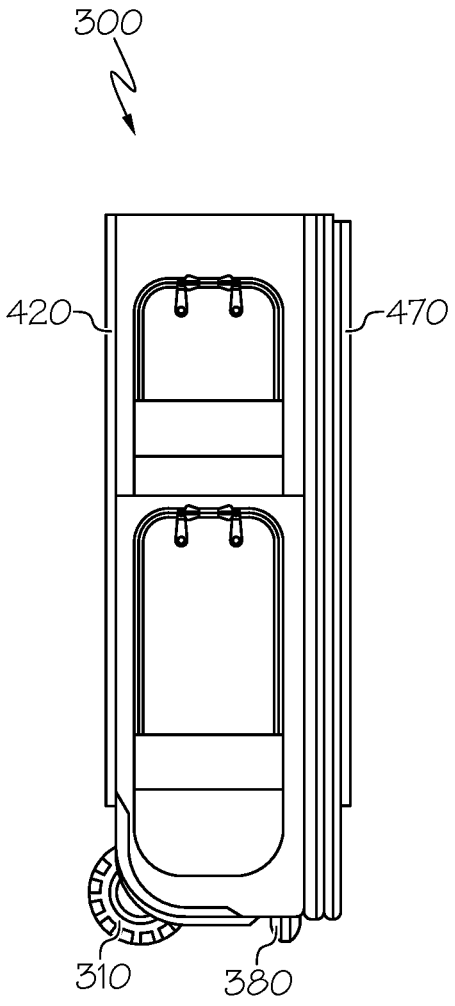
FIGS. 4A and 4B are side views of an embodiment of a third body of a luggage system in an un-expanded mode and an expanded mode, respectively, in accordance with the present inventive concepts.
Figure 4B:
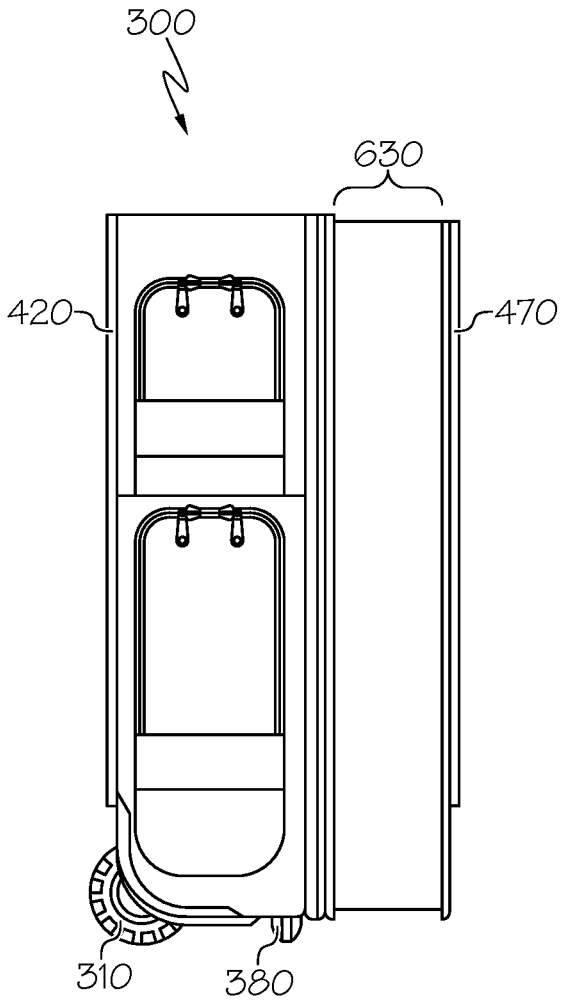

FIGS. 4A and 4B are side views of an embodiment of a third body 300 of a luggage system 1000 in an un-expanded mode and an expanded mode, respectively, in accordance with the present inventive concepts. In this embodiment, one portion 420, 470 of each of the first and second attachment mechanisms 400, 450 is mounted to or sewn on the suitcase unit 300, and the other portion 410, 460 of the attaching zippers is mounted to or sewn on the first body 100 and the second body 200, respectively (not shown in FIG. 4). This modular system enables the three units to be attached/unattached in various modes (all three bodies 100, 200, 300 together, all bodies separated 100, 200, 300, front and back units 200, 100 separated from suitcase 300 and reconnected to form a daypack, or one unit 100 or 200 connected to the suitcase unit 300 and the other 200 or 100 disconnected.)

In one advantageous aspect, the system 1000 can be sold in its entirety (e.g. all three units 100, 200, 300), or as individual components (e.g. just the suitcase 300, or just the front 200 or back 100 units.) A user can optionally pair different styles of front units 200 or back units 100 with the suitcase 300, for different types of trips. For example, a traveling pair can have a front unit 200 and back unit 100 that convert into a backpack, as shown herein, for trips one partner takes, and a separate front unit 200 and back unit 100 that would convert into a briefcase for trips the other partner would take, if the second partner prefers a briefcase to a daypack. Many other embodiments of this concept of selling separate front units or back units or suitcases are possible, such as use of different colors, fabrics, or other design features. For example, a front unit 200 can be configured with task-specific pockets, straps, attachments to carry for example, a skateboard, tennis racket, or other specialty item.

Figure 5:
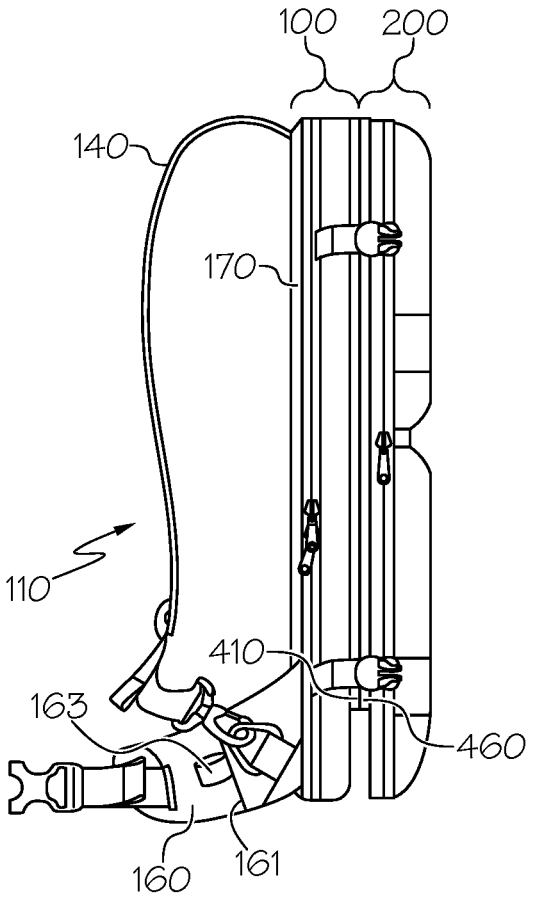
FIG. 5 is a side view of an embodiment of a luggage system in accordance with the present inventive concepts.

FIG. 5 is a side view of an embodiment of a luggage system 1000 in accordance with the present inventive concepts. In this view, the rear suspension unit 100 is connected to the front unit 200 to form a daypack configuration. In the embodiment shown in FIG. 5, the suspension unit 100 comprises the hip belt 160. (Note that various sizes and shapes of hip belts are possible, in addition to the one shown in the diagram.) As described herein, the hip belt 160 can be configured to slides behind the back panel 170 at the rear of the unit. A loop 163 and a crease 161 are present on the hip belt 160. The hip belt 160 can be configured to folds back onto itself at the on the crease 161 when being stowed behind the back panel 170, when not required. When deploying the hip belt 160, a user can pull on the loop while still wearing the backpack on their back. As a result, less effort is required by a user for accessing the hip belt 160 for deployment. In some embodiments, the hip belt 160 is coupled to the first body 100 with hook and loop material, or a similar attachment mechanism.

Figure 6A:
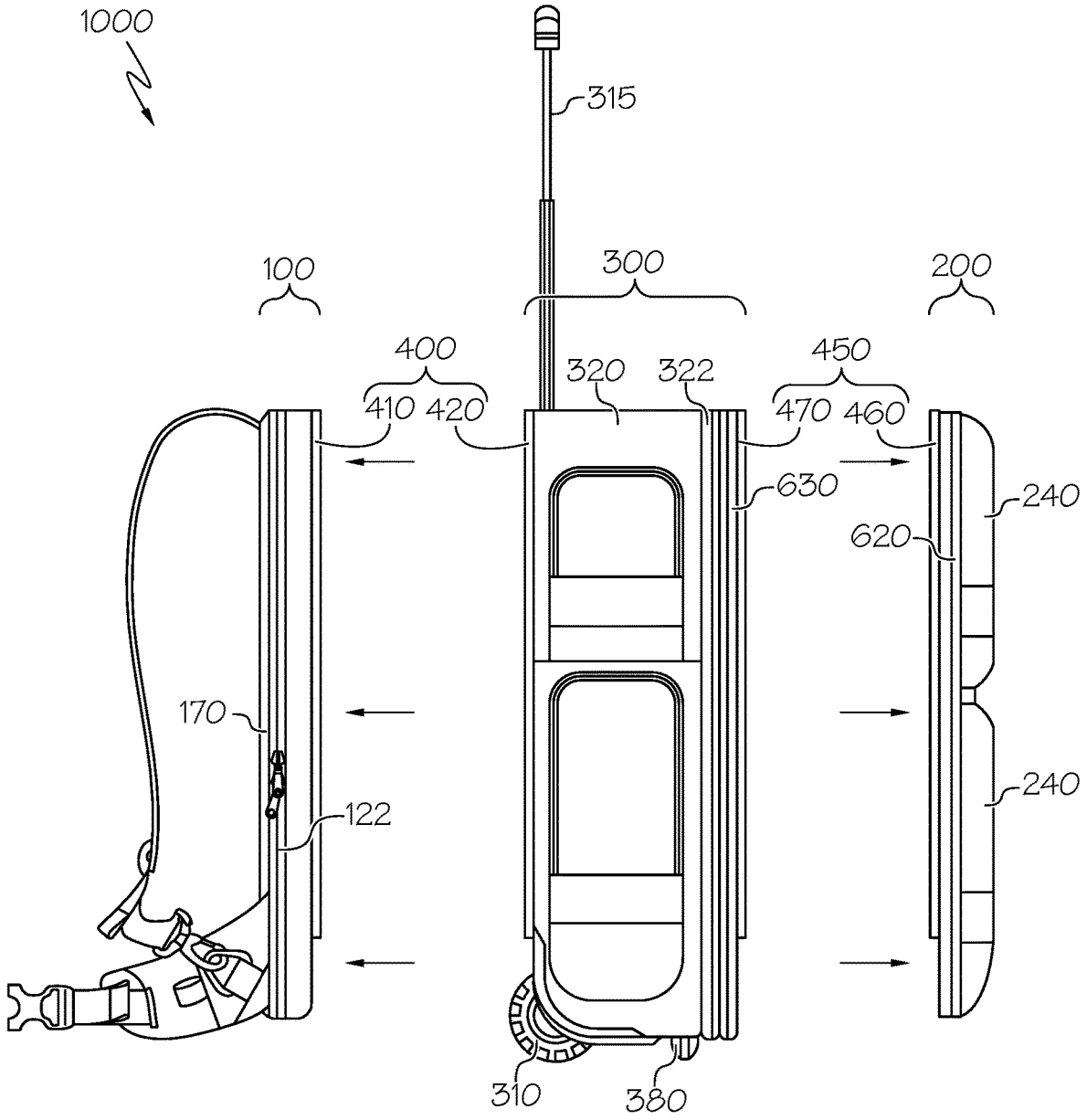
FIGS. 6A and 6B are side views of an embodiment of a luggage system in accordance with the present inventive concepts.
Figure 6B:
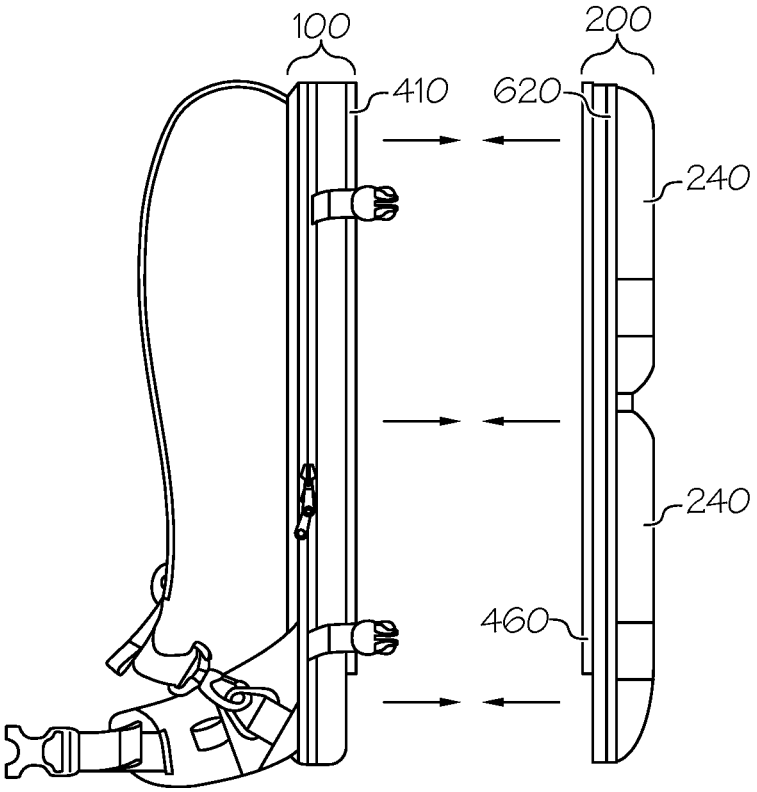

In some embodiments, the rear unit 100 comprises two shoulder straps 140. In other embodiments, the rear unit 100 comprises a single strap 140, so that it could be carried like a "messenger bag" or "cross-body bag". In other embodiments features can be added to the straps 140. For example, a "sternum strap" 145 can be coupled between left and right shoulder straps 140*a*, 140*b* (see FIG. 19) to fasten the two shoulder straps 140 together so that they do not slip off of the shoulders of the wearer. Such a sternum strap 145 can also be designed so that it could be hidden, or zipped inside of, the shoulder straps, into a sternum strap pocket 147, if the wearer did not want to use it. In some embodiments, the sternum strap 145 is removable. FIGS. 6A, 6B, 7A, and 7B are side views of an embodiment of a luggage system 1000 in accordance with the present inventive concepts. FIG. 6A illustrates separation of the front unit 200 and the rear suspension unit 100 from the suitcase unit 300. FIG. 6B illustrates reattached of the front unit 200 to the rear unit 100 to form a daypack unit. In the side view of FIG. 7A, the daypack 100, 200 is depicted in a non-expanded mode; while in the side view of FIG. 7B, the daypack 100, 200 is depicted in an expanded mode. These diagrams also show how the compression straps 710, 720, which, in the front unit 200, deploy when the expansion zipper 620 is unzipped, can be used to compress the daypack 200 to the desired depth. In some embodiments, the first body 100 comprises a polyethylene (PE) stiffener. In the embodiment shown in FIG. 6, the second body 200 comprises a stiffener board. The stiffener board operates as a panel that resists deformation of the first of second bodies 100, 200 in their respective attachment regions. In some embodiments, the stiffener board comprises a PE stiffener board 210 and 2 mm of PE foam wrapped in fabric. In other embodiments, the second body 200 may comprise a different amount of PE foam. In some embodiments, the stiffener is oriented in a vertical direction near the front of the first body 100. In some embodiments, the stiffener is oriented in a vertical direction near the rear of the second body 200. If this first 100 or second 200 body is filled with items, those items may affect the contours of the first 100 or second 200 body such that it is difficult to couple with other units. In some embodiments, the stiffener is constructed and arranged to prevent such connection problems and ensure that the first 100 or second 200 body can effectively mate with other units.

Figure 7B:
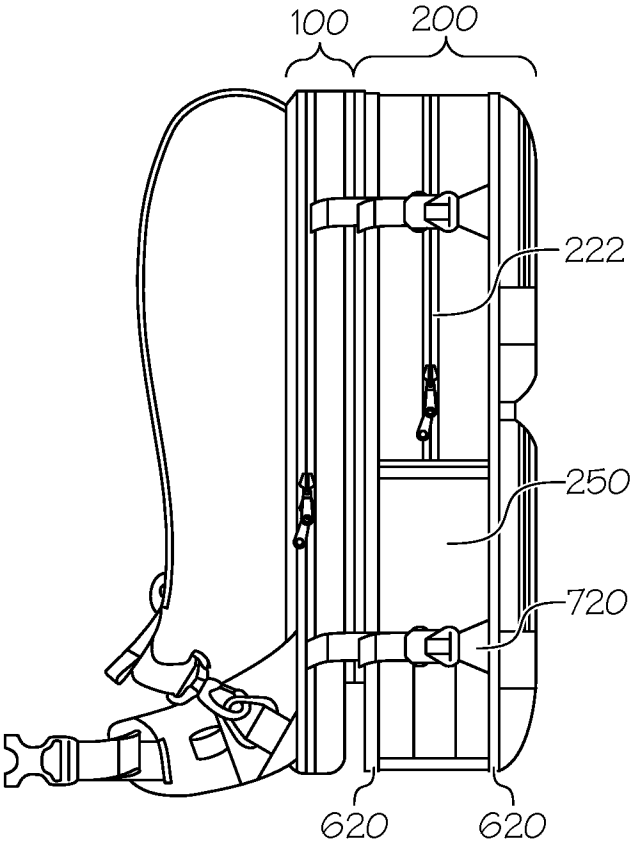
FIGS. 7A and 7B are side views of an embodiment of a luggage system in accordance with the present inventive concepts.
Figure 7A:
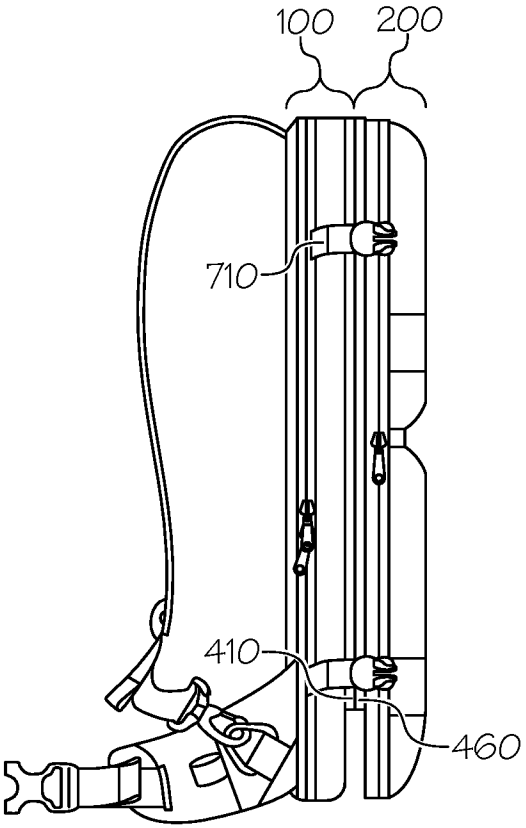

FIG. 7A shows the first body 100 coupled to the second body 200. FIG. 7B shows the first body 100 coupled to the second body 200 and further depicts the second body 200 in an expanded mode. In some embodiments, the compression straps 710, 720 are used to adjust the degree of expansion of the second body 200. In some embodiments, the expanded portion of the second body comprises at least one side pocket 250, as described herein.

Figure 8:
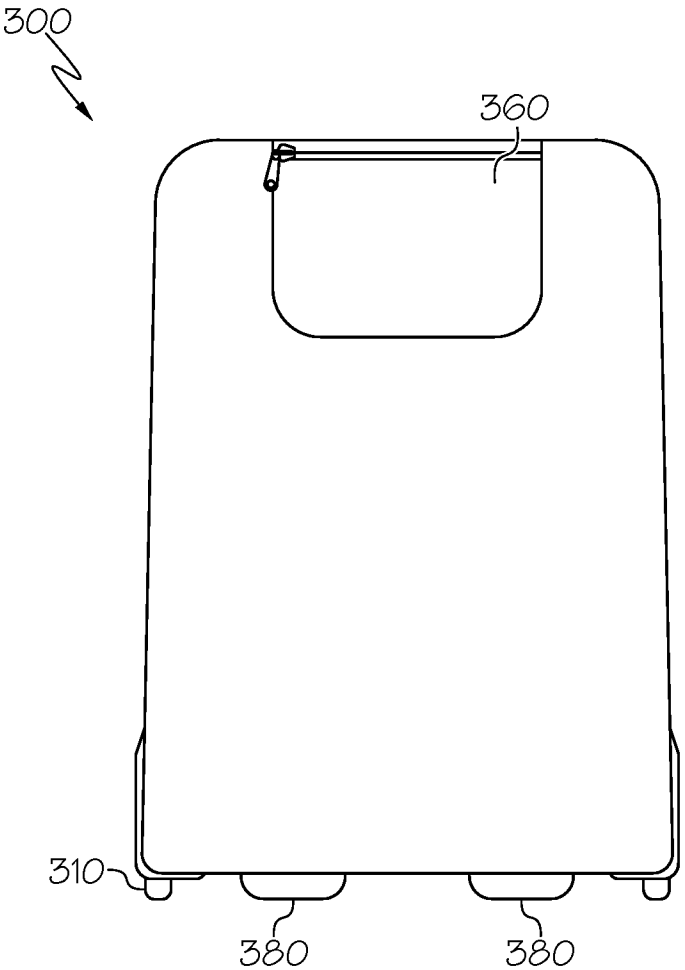
FIG. 8 is a front view of an embodiment of the suitcase unit comprising a front pocket in accordance with the present inventive concepts.

FIG. 8 is a front view of an embodiment of the suitcase unit 300 comprising a front pocket 360 in accordance with the present inventive concepts. In some embodiments the front pocket 360 comprises an access mechanism, such as a zipper, button, clasp, or hook. In some embodiments, the front pocket 360 is constructed and arranged to secure a passport. In some embodiments, the front pocket 360 is constructed and arranged to secure a wallet.

Figure 9:
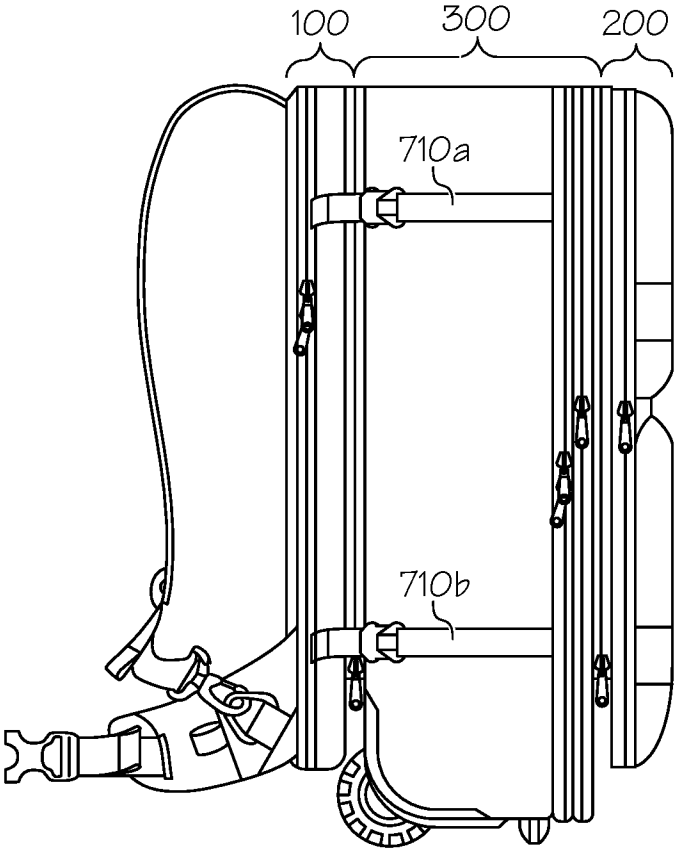
FIG. 9 is a side view of an embodiment of a luggage system in which the suitcase unit is absent of side pockets in accordance with the present inventive concepts.

FIG. 9 is a side view of an embodiment of a luggage system 1000 in which the suitcase unit 300 is absent of side pockets in accordance with the present inventive concepts. In this embodiment, the compression straps 710 extend from the first body 100 to the front of the suitcase unit 300.

Figure 10:
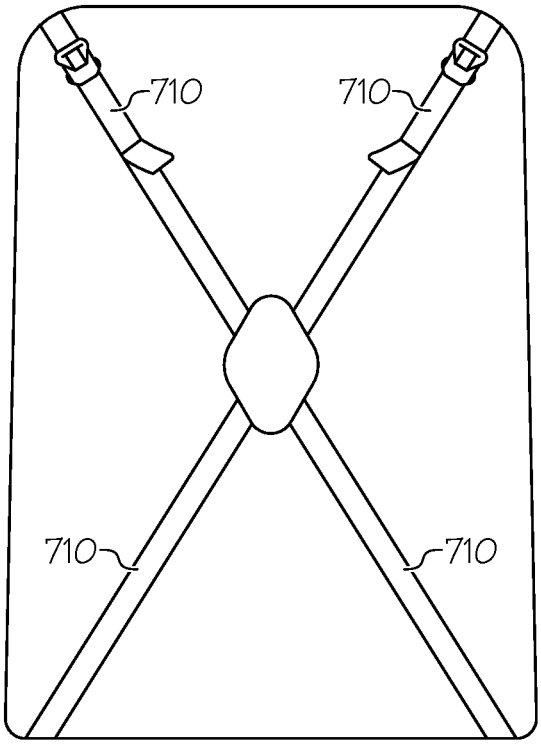
FIG. 10 is a front view of an embodiment of a suitcase unit in accordance with the present inventive concepts.

FIG. 10 is a front view of an embodiment of a suitcase unit 300 in accordance with the present inventive concepts. FIG. 10 shows the compression straps 710*a*, 710*b*, 710*c*, 710*d* converging on the front surface of the suitcase unit 300. In some embodiments, the compression straps 710 from the first body 100 are sewn to the center of the front of the third body 300.

FIG. 11 is a bottom view of an embodiment of a luggage system 1000 in accordance with the present inventive concepts. In this embodiment, the first 100, second 200, and third 300 bodies each comprise two feet 180, 280, 380. In the embodiment shown, the feet are aligned. In other embodiments, the system comprises a different number of feet and the feet are not aligned. In some embodiments, the feet on each body are separated by a suitable distance, for example, 75 mm. In other embodiments, the feet on each body are separated by a different amount.

Figure 12:
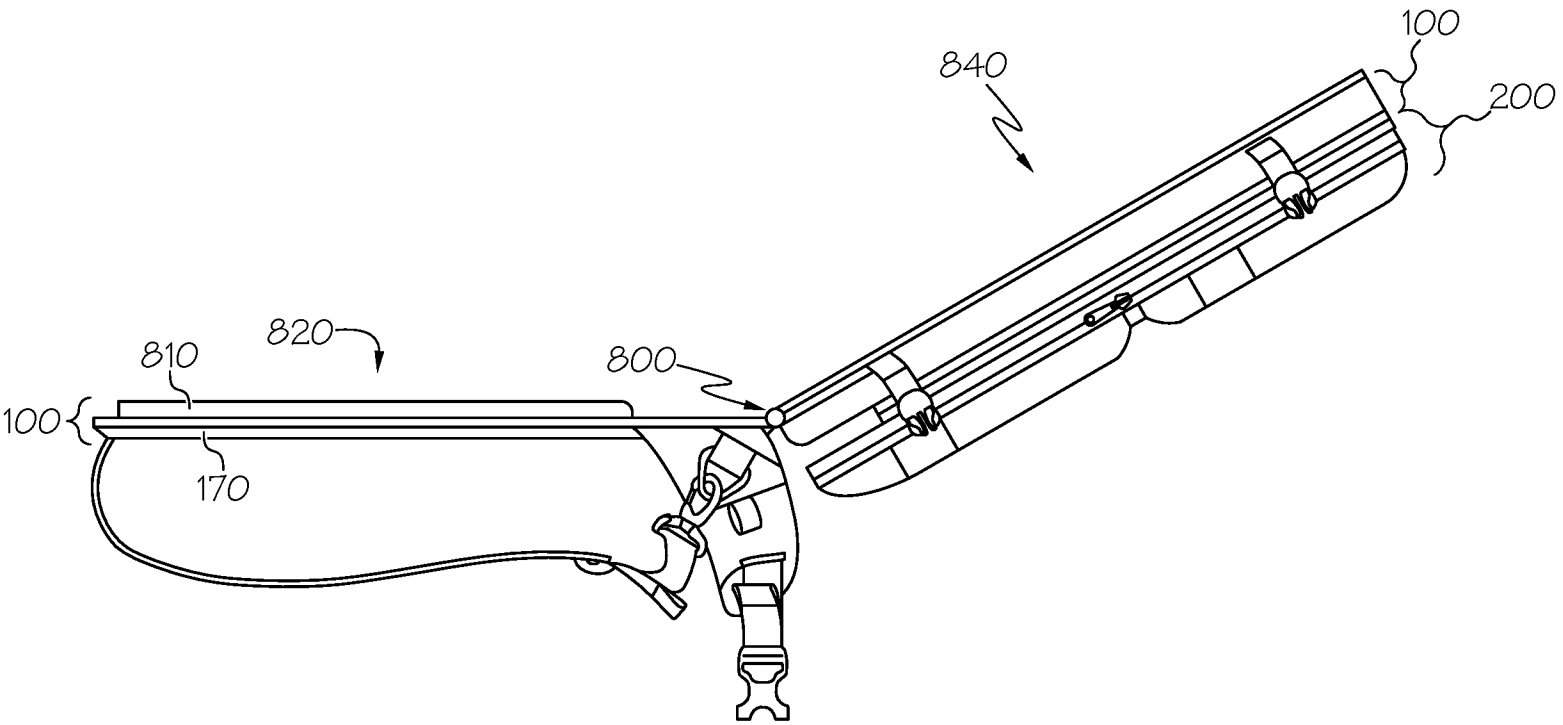
FIG. 12 is a side view of an embodiment of a luggage system in accordance with the present inventive concepts.

FIG. 12 is a side view of an embodiment of a luggage system 1000 in accordance with the present inventive concepts. In some embodiments, the first body/rear unit 100 can be configured as a TSA "checkpoint friendly" device. In FIG. 12, the first body 100 is coupled to the second body 200. In the embodiment shown in FIG. 12, the first body 100 comprises a first portion 820 and a second portion 840. In some embodiments, the first portion 820 and the second portion 840 are coupled with a mechanical hinge 800 or mechanical axle. In some embodiments, the hinge 800 comprises reinforced fabric and/or webbing. In other embodiments, the first portion 820 and the second portion 840 are coupled with other suitable attachment mechanisms.

According to the TSA (Transportation Security Administration), a backpack is to exhibit the following to be designated as "checkpoint friendly", so that a computer can be screened without being removed from the bag:

For a bag to be considered checkpoint friendly is should meet the following standards: A designated laptop-only section

- The laptop-only section completely unfolds to lie flat on the X-ray belt
- No metal snaps, zippers or buckles inside, underneath or on top of the laptop-only section
- No pockets on she inside or outside of the laptop-only section
- Nothing packed in the laptop-only section other than the computer itself.

Embodiments of the rear unit 100 can incorporate the requirements of the checkpoint-friendly specifications, as partially shown in FIG. 12:

- The access zipper 122 of the rear unit 100, which is located at the REAR of the rear unit (close to the padding for the back), unzips on three sides (left side, right side, and top), while the bottom side forms a hinge 800 with the rest of the rear unit 100. Note that only one zipper is needed to accomplish this design.
- The laptop only section will then be a slim pocket 810 (not shown in the diagram) in the flap that folds out, into which the computer will be placed. This may be secured by a Velcro strap 815 or other closure device that does not use metal snaps, zippers, or buckles.
- While nothing but the computer will be stored in the laptop-only section mentioned above, other items (such as cables, files, discs, clothing, etc., may be stored in the remainder of the cavity of the rear unit 100 not occupied by the computer. This is advantageous compared to a design that requires only the computer and nothing else to be stored in the entire cavity.
- While straps and buckles are positioned at on the sides of the rear unit 100 in order to attach it to the suitcase 300 or the front unit 200, these are not to be metal, and, since they are placed on the side of the unit, do not interfere with the checkpoint friendly designation.

Figure 13:
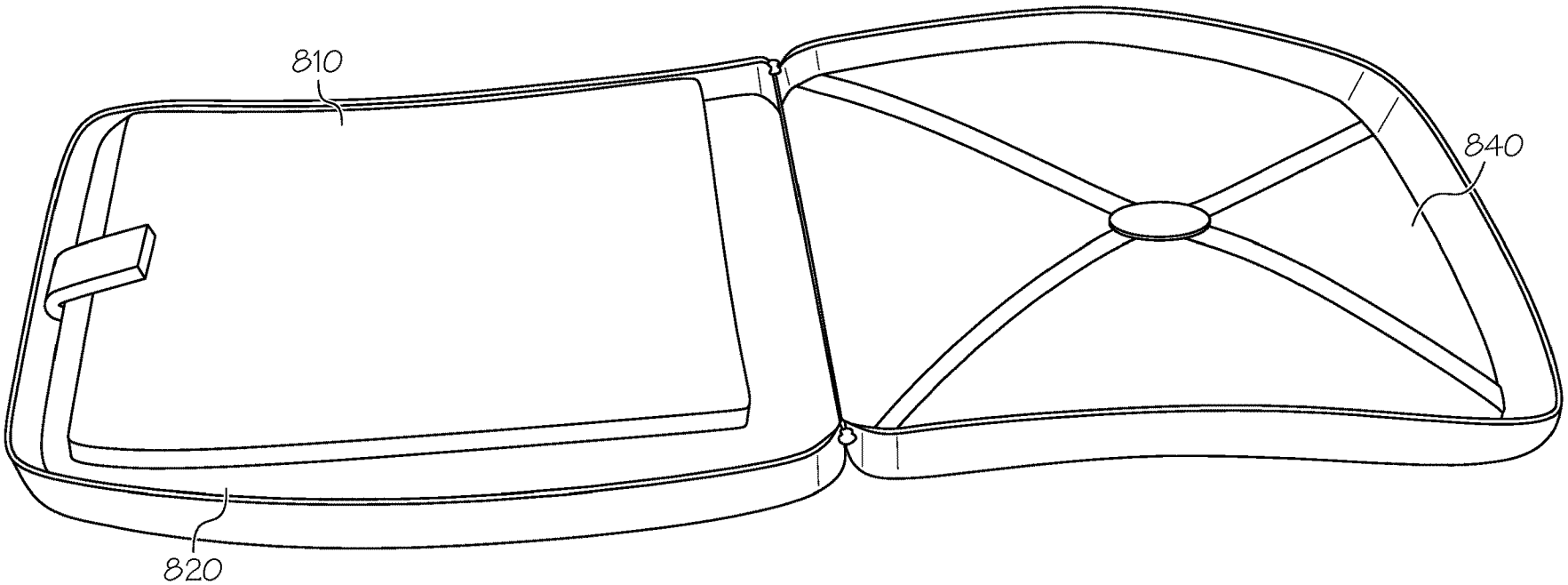
FIG. 13 is a side perspective view of an embodiment of the TSA-friendly first body 100 in the open position in accordance with the present inventive concepts.

FIG. 13 is a side perspective view of an embodiment of the TSA-friendly first body 100 in the open position in accordance with the present inventive concepts.

Figure 14:
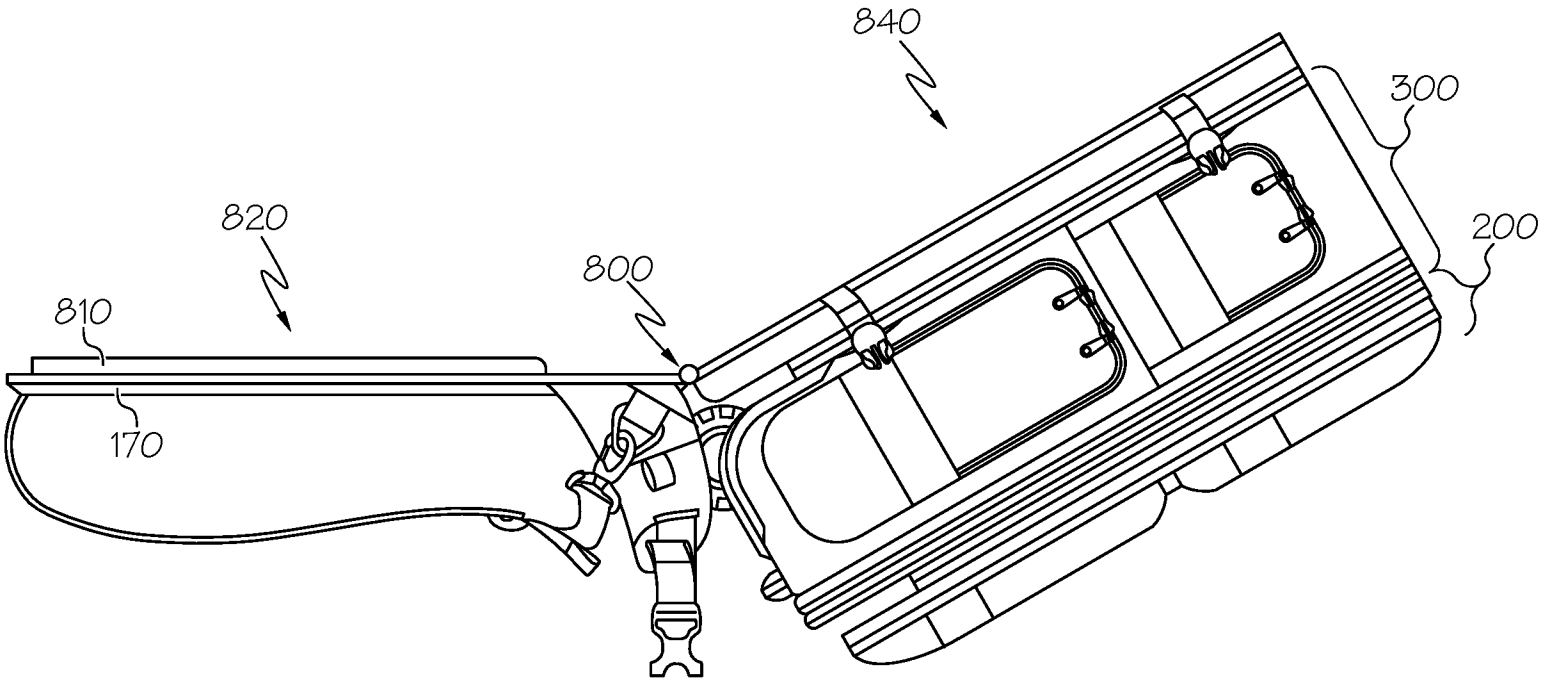
FIG. 14 shows a side view of an embodiment of the TSA-friendly first body coupled to the second body and the third body in accordance with the present inventive concepts.

FIG. 14 is a side view of an embodiment of the TSA-friendly first body 100 coupled to the second body 200 and the third body 300 in accordance with the present inventive concepts. This checkpoint-friendly TSA approved design, allows for a quick rearrangement of the TSA-compliant section, while not requiring full separation from the carry-on. The rear unit 100 and the front unit 200 can later be disconnected from the suitcase unit 300 at a later time, at a time that is convenient to a traveler.

Figure 15:
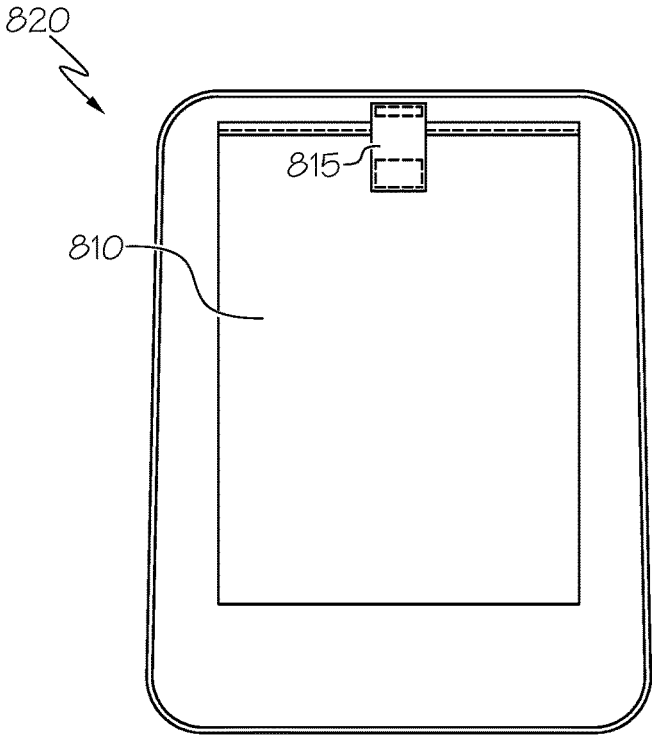
FIG. 15 shows a front view of an embodiment of a first portion of the first body in accordance with the present inventive concepts.

FIG. 15 is a front view of an embodiment of a first portion 820 of the first body 100 in accordance with the present inventive concepts. In some embodiments, the first portion 820 of the first body 100 comprises a storage mechanism 810 constructed and arranged to store a computer in a TSA checkpoint-friendly manner. In some embodiments, the storage mechanism 810 comprises a strap 815 constructed and arranged to secure a computer in place within the storage mechanism. The strap 815 may comprises different features that are constructed and arranged to secure the strap 815 in place. These features may include, but are not limited to, hooks, Velcro, buttons, etc. In other embodiments, the storage mechanism is accessed using a zipper. In some embodiments, the storage mechanism 810 comprises 5 mm of PE foam fleece lining. In some embodiments, the storage mechanism 810 comprises a different amount and/or type of lining.

Figure 16:
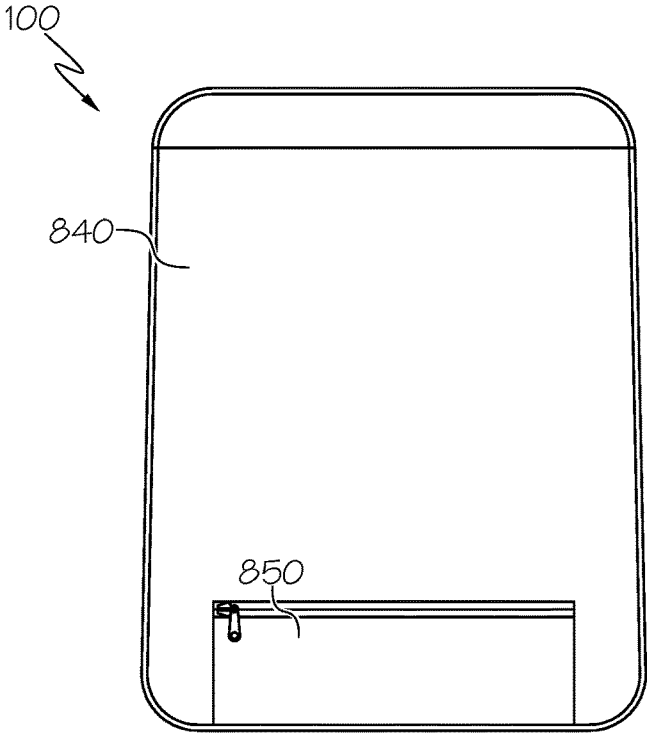
FIG. 16 is a front view of an embodiment of the second portion of the first body 100 in accordance with the present inventive concepts.

FIG. 16 is a front view of an embodiment of the second portion 840 of the first body 100 in accordance with the present inventive concepts. Note that the computer is positioned in within the central volume of the first body when the rear unit 100 is closed and secured. A pouch 850 below the computer area, in this case a mesh pocket, remains in the cavity of the second portion 840 when the computer is folded out with the first portion 820. As a result, the pouch can be used for storing cables, etc., within the TSA compliance rules. In some embodiments, the pouch 850 comprises an access mechanism such as a zipper, button, etc. In some embodiments, the pouch 850 is constructed and arranged to retain a passport or wallet.

In some embodiments described herein, the first body 100 is TSA checkpoint-friendly. In other embodiments, the second body 200 can be configured as TSA-checkpoint-friendly. In other embodiments, both the first body 100 and the second body 200 are TSA checkpoint-friendly.

Figure 17:
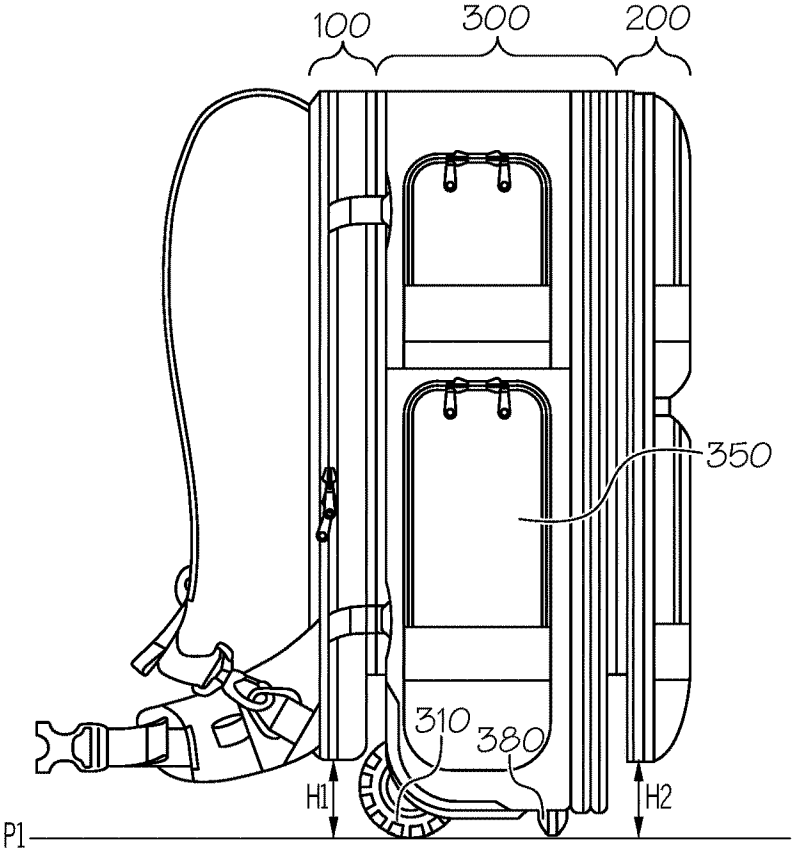
FIG. 17 is a side view of an embodiment of a luggage system in accordance with the present inventive concepts.

FIG. 17 is a side view of an embodiment of a luggage system 1000 in accordance with the present inventive concepts. A lower portion 105 the first body 100 is positioned at a height H1 relative to a lowermost position P1, of the third body 300. In the present embodiment, the lowermost position P1 of the third body 300 is at a position at a bottom of wheel 315 and/or at a bottom of foot 380. The second body is positioned a second height H2 relative to the lowermost position P1. In some embodiments, the first height H1 and the second height H2 are substantially similar. In other embodiments, the first height H1 and the second height H2 are different. Note that in the present embodiment, the front 200 and back 100 units are shorter in height than the suitcase unit 300. This configuration allows the suitcase unit to have rolling wheels 310, as shown in the figure, but permits the rear unit 100 to avoid interfering with the wheels 310 when the bag is being rolled. Since the bag will normally be positioned at a non-vertical angle when being rolled, by having the rear unit 100 shorter than the suitcase unit 300, the bag can be tilted at an angle and still roll with adequate clearance for avoiding the lower corner region of the rear unit 100 from scraping the ground. In some embodiments, the rear unit 100 is approximately 1.5 inches shorter than the suitcase unit. Other dimensions are equally applicable to the present inventive concepts.

In the present embodiment, the computer is to be stored in its laptop-only section of the rear unit 100 in a way that it avoid occupying the bottom 1.5 inches of the rear unit 100. This will permit the computer to be viewed by the TSA screening technology in an unobstructed way when it is folded out. If the computer were to be stored at a position lower in the compartment, that is, lower than 1.5 inches from the bottom part of the computer would be obscured from the screening device by the suitcase unit 300, after the rear unit was unfolded.

In some embodiments, a clearance is present between the attachment mechanism that couples the first body 100 to the third body 300 and the at least one wheel 310.

Figure 18:
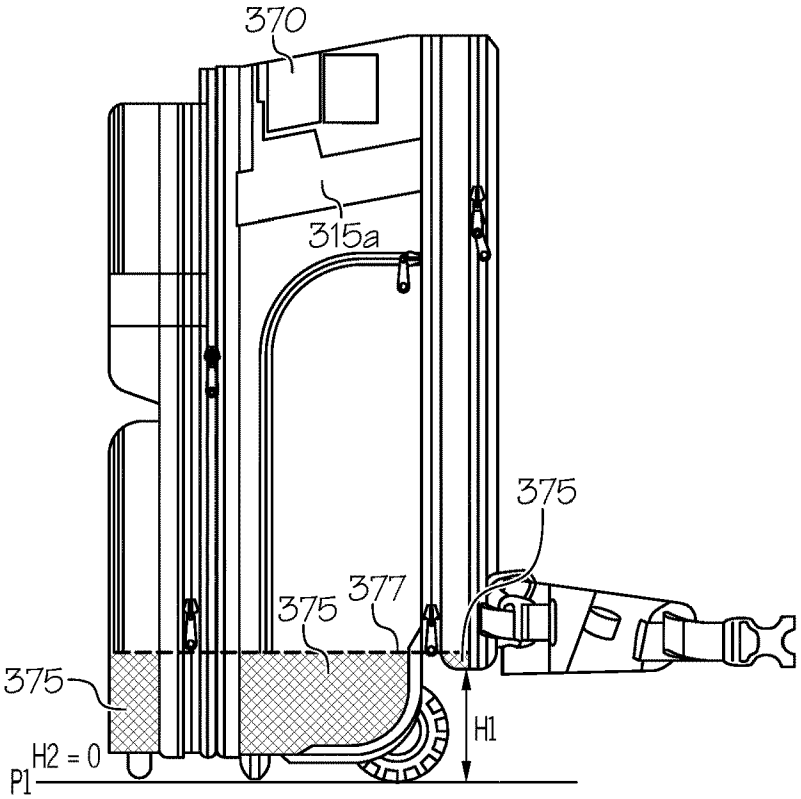
FIG. 18 is a side view of an embodiment of the luggage system in accordance with the present inventive concepts.

FIG. 18 is a side view of an embodiment of the luggage system 1000 in accordance with the present inventive concepts. In the embodiment shown in FIG. 18, the first height H1 of the first body 100 relative to the lowermost position P1 of the third body 300 is larger than that shown in the embodiment of FIG. 17. At the same time, the second height H2 of the second body 200 relative to the lowermost position P1 of the third body 300 is less than that shown in the embodiment of FIG. 17. In the present embodiment, the second height H2 is 0, as the second body rests on the ground along with the third body 300 when the second body 200 is attached to the third body 300.

In the embodiment of FIG. 18, the third body 300 comprises a side pocket 350 that has a curved access mechanism. In the embodiment shown, the system comprises metal rivets and bartack reinforcement 370. In the embodiment shown, the third body 300 comprises a nylon webbing grab handle 315*a*. In other embodiments, the system comprises a grab handle that comprises a suitable material other than nylon. In the embodiment shown in FIG. 18, the luggage system 1000 comprises contrast material 375. In the embodiment shown in FIG. 18, the contrast material 375 is constructed and arranged to form an alignment guide that may assist the user in coupling different bodies. The alignment is indicated in FIG. 18 with a dashed line 377.

Figure 19:
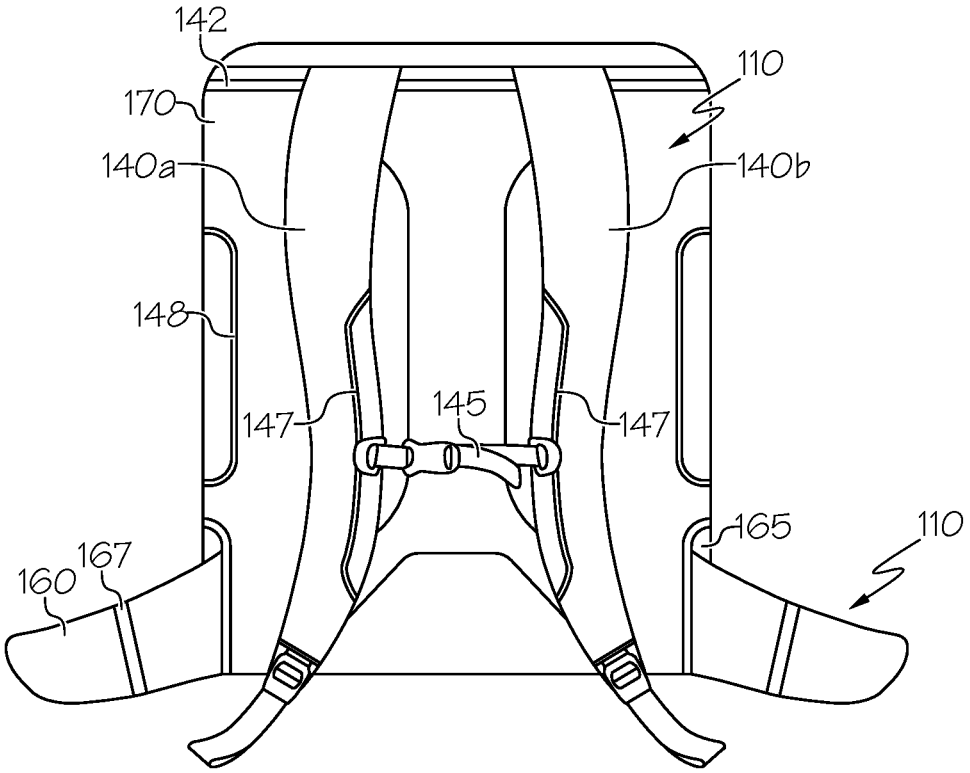
FIG. 19 is a rear view of an embodiment of a first body in accordance with embodiments of the present inventive concepts.

FIG. 19 is a rear view of an embodiment of a first body 100 in accordance with embodiments of the present inventive concepts. In the embodiment shown in FIG. 18, the first body 100 comprises a backpack suspension 110 with two straps 140 and a hip belt 160. In the embodiment shown, the hip belt 160 stows behind the back panel 170 and passes through a hip belt passage 165. In some embodiments, the hip belt 160 comprises the crease 167. In some embodiments, the crease 167 is absent of padding to accommodate folding. In the embodiment shown in FIG. 19, the first body further comprises a strap pocket 142 and a sideways passage 148. In the embodiment shown in FIG. 19, the straps 140 can be stored in the strap pocket 142. In some embodiments, the sideways passage 148 in the middle region of the back panel 170 permits the unit 100, when turned sideways, to be mounted on the handle of a larger rolling bag, to make carrying easier. In some embodiments, the sideways passage 148 passes from one side of the first body 100 to the other side of the first body 100. In the embodiment shown in FIG. 19, the hip belt 160 passes through the hip belt passage 165. In the embodiment shown in FIG. 19, the first body 100 comprises a sternum strap 145 between the two straps 140. In some embodiments, the position of the sternum strap 145 is adjustable. In some embodiments, the tension in the sternum strap 145 is adjustable.

In some embodiments, each strap 140 comprises at least one sternum strap pocket 147 constructed and arranged for storing components of the sternum strap 145.

Figure 20:
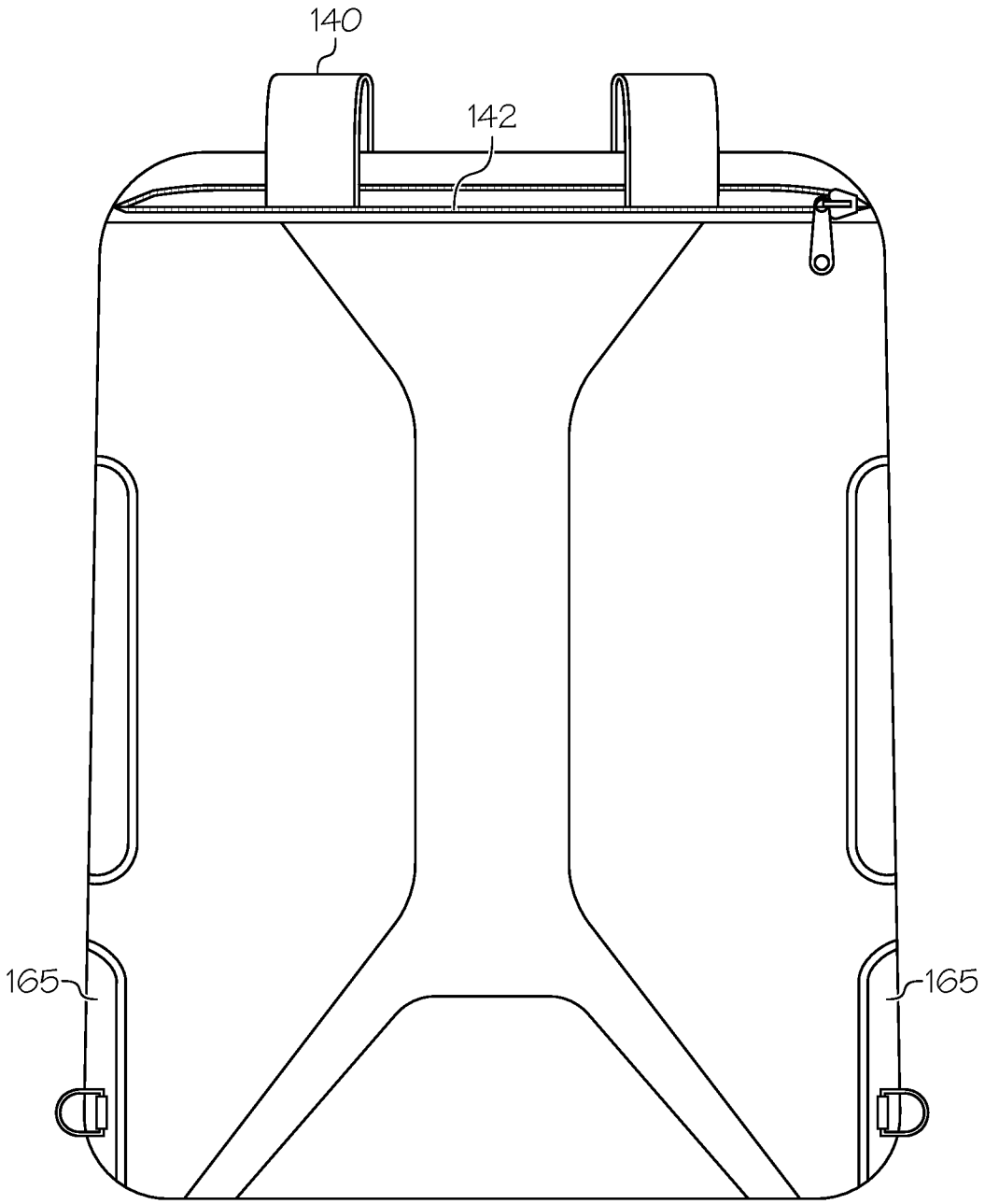
FIG. 20 is a rear view of an embodiment of the first body in accordance with the present inventive concepts.

FIG. 20 is a rear view of an embodiment of the first body 100 in accordance with the present inventive concepts. In this illustration, it can be seen that the straps 140 can be detached from the body 100 at their lower portions to enable them to be stored in the strap pocket 142. Similarly, the hip belts 160 and hip 150 straps can be stored in the respective hip belt passages 165.

Figure 21:
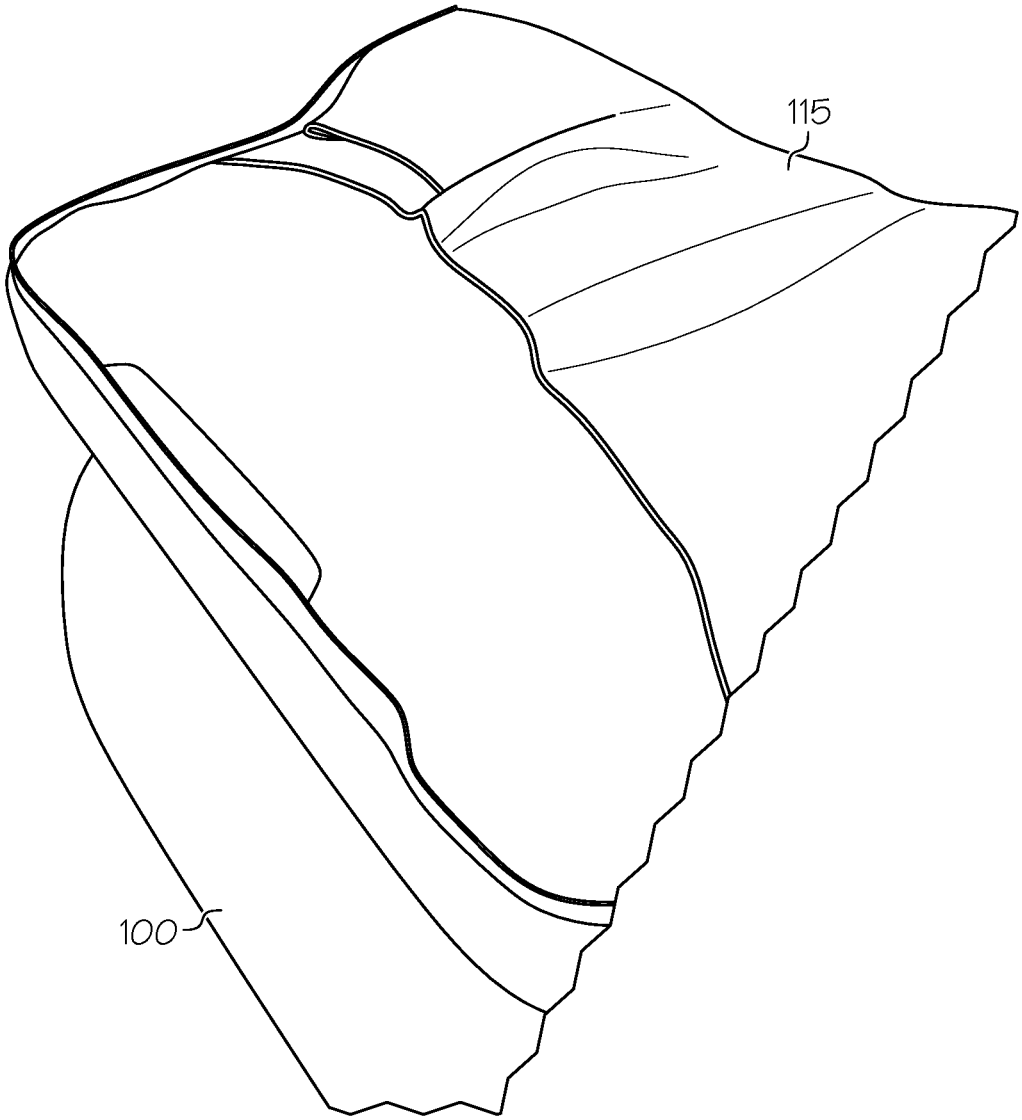
FIG. 21 is a perspective view of a cover being applied to an embodiment of a first body in accordance with the present inventive concepts.

FIG. 21 is a perspective view of a cover 115 being applied to an embodiment of a first body 100 in accordance with the present inventive concepts. The cover 115 can provide additional protection of the first body 100 when it is being checked as checked luggage. The cover can be applied to the first body 100 via an attachment mechanism, for example a zipper.

Figure 22:
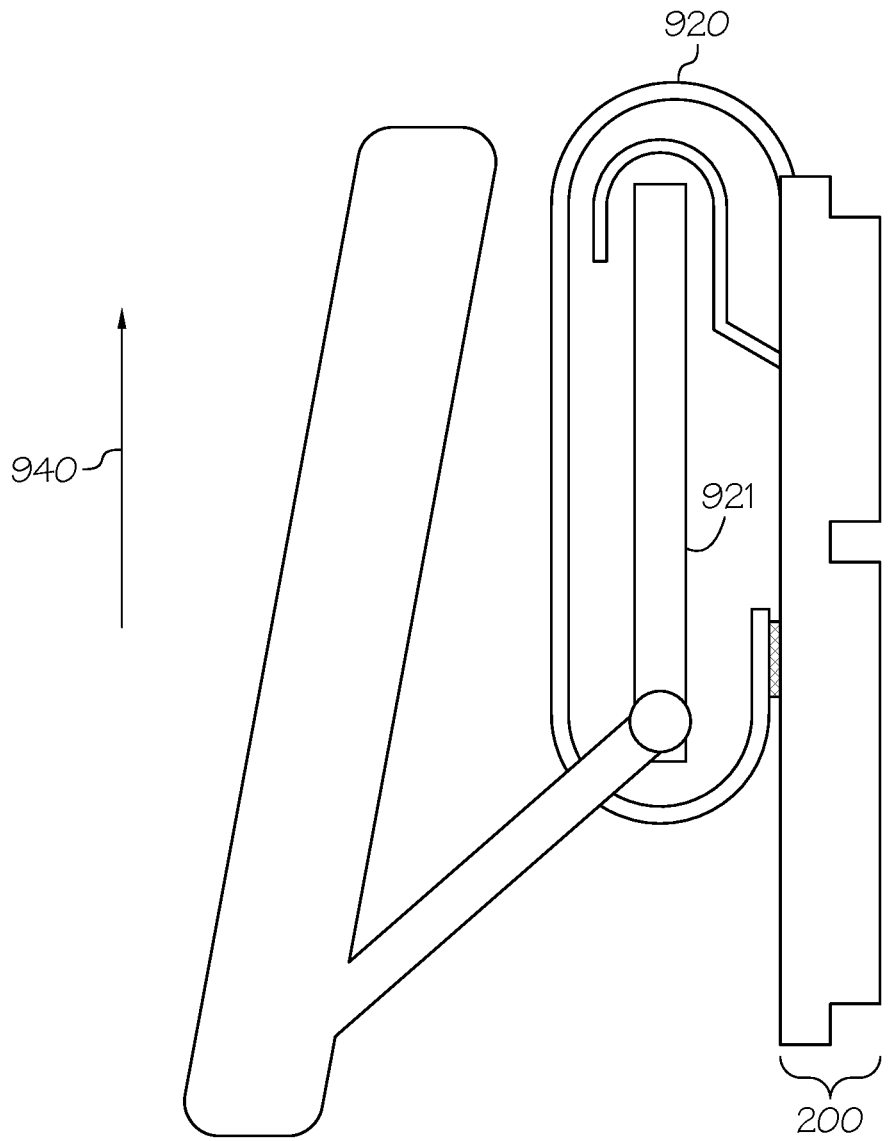
FIG. 22 shows a side view of a second body coupled to a tray in accordance with the present inventive concepts.

FIG. 22 is a side view of a second body 200 coupled to an airplane seat tray 921 in accordance with the present inventive concepts. In the embodiment shown in FIG. 26, the second body 200 comprises a suspension mechanism 900 coupled to a first exterior 270 of the second storage region 220. In some embodiments, the back of the front or backpack unit can include fold-out hooks 910 and/or straps 920 or both that will allow the unit 200 to be mounted to the back of an airplane seat, or similar surface. The hooks 910 and/or straps 920 may extend along a first axis 940. This is a convenient feature for travelers, as they can simply unzip the front unit 200, hang it from the airplane seat in front of them, and have everything in the front unit's 200 pockets readily available for the flight. This functionality can be enabled by the front unit 200 being a separate unit, so that it is flat enough to be hung easily, without the larger backpack shoulder straps 140 or the hip belt 160 getting in the way. In other embodiments, the unit 200 could be hung from other structures, such as shelves or tables.

Figure 23:
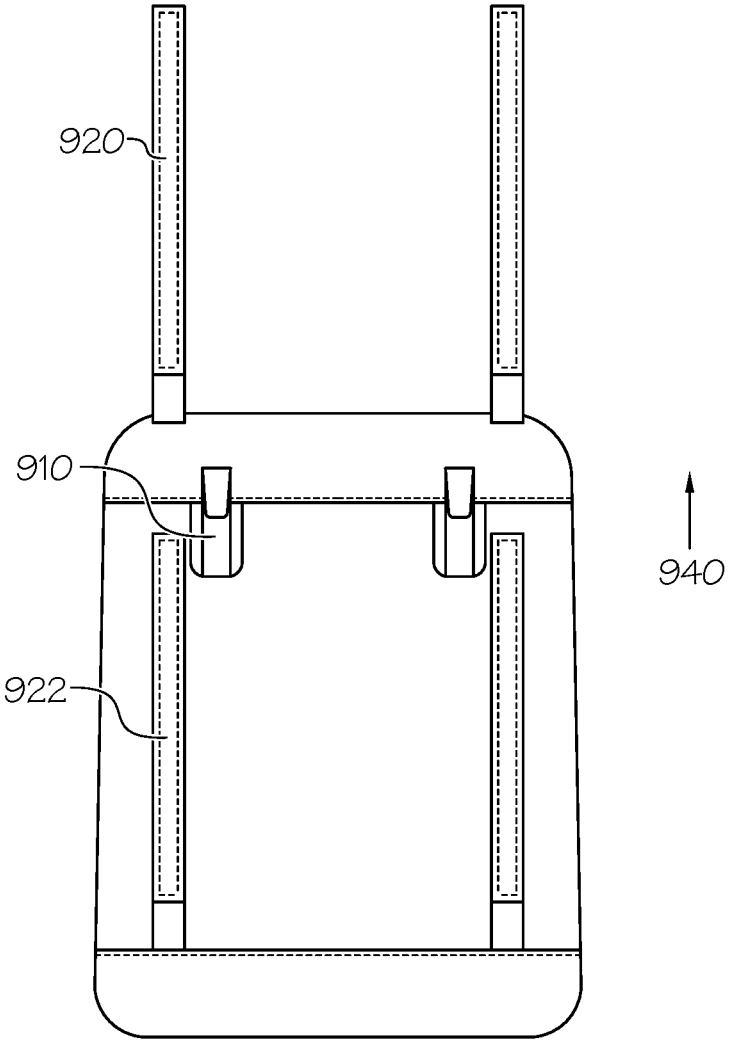
FIG. 23 is a rear view of an embodiment of the second body in accordance with embodiments of the present inventive concepts.

FIG. 23 is a rear view of an embodiment of the second body 200 in accordance with embodiments of the present inventive concepts. In this embodiment, two straps 920 are constructed and arranged to couple to pads 922 on the back surface of the second body 200. In some embodiments the straps 920 couple to the pads 922 using Velcro. In other embodiments, the straps 920 couple to the pads 922 using other attachment mechanisms including, but not limited to, glue, buttons, straps, etc. In this embodiment, the second body also comprises two hooks 910. In the embodiment shown in FIG. 23, the hooks 910 are molded hooks, but other embodiments comprise different types of hooks.

Figure 24A:
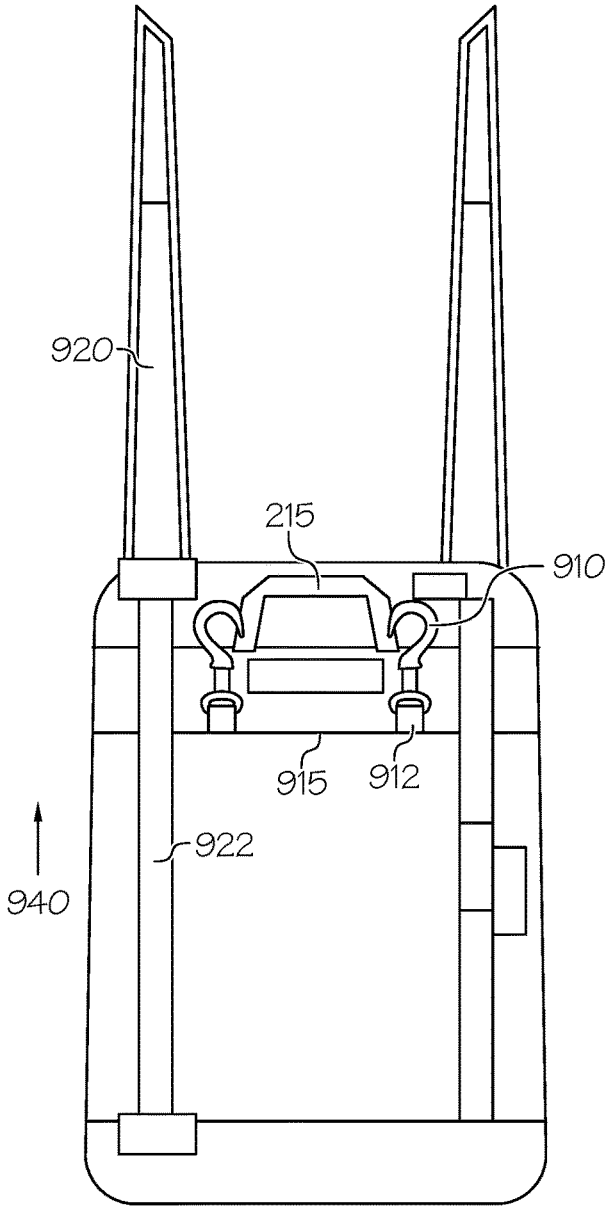
FIG. 24A is a rear view of an embodiment of the second body in accordance with embodiment of the present inventive concepts.

FIG. 24A is a rear view of an embodiment of the second body 200 in accordance with embodiment of the present inventive concepts. In this embodiment, two straps 920 are constructed and arranged to couple to Velcro pads 922 on the back surface of the second body 200. In this embodiment, the ends of each strap 920 are angled at 45 degrees. In other embodiments, the ends of each strap 920 are angled differently. In this embodiment, the second body 200 comprises a handle 215. In the embodiment illustrated in FIG. 24, the handle 215 is a webbing handle 215 connected to the second body 200 with bartack reinforcement.

In this embodiment, the second body 200 also comprises two hooks 910. In this embodiment, the hooks are swiveling hooks 910 and are coupled to the second body 200 with webbing 912. In other embodiment, the second body comprises different types of hooks and the hooks are secured differently.

In the embodiment shown in FIG. 24A, the second body 200 also comprises a hook pocket 915. In some embodiments, the at least one hook 910 is stored in the hook pocket 915.

Figure 24B:
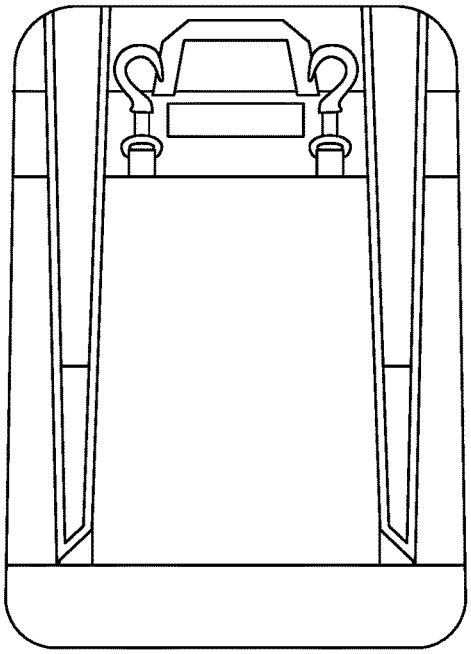
FIG. 24B illustrates an embodiment of the second body with the straps coupled to the pads in accordance with embodiment of the present inventive concepts.

FIG. 24B illustrates an embodiment of the second body 200 with the straps 920 coupled to the pads 922.

Figure 25:
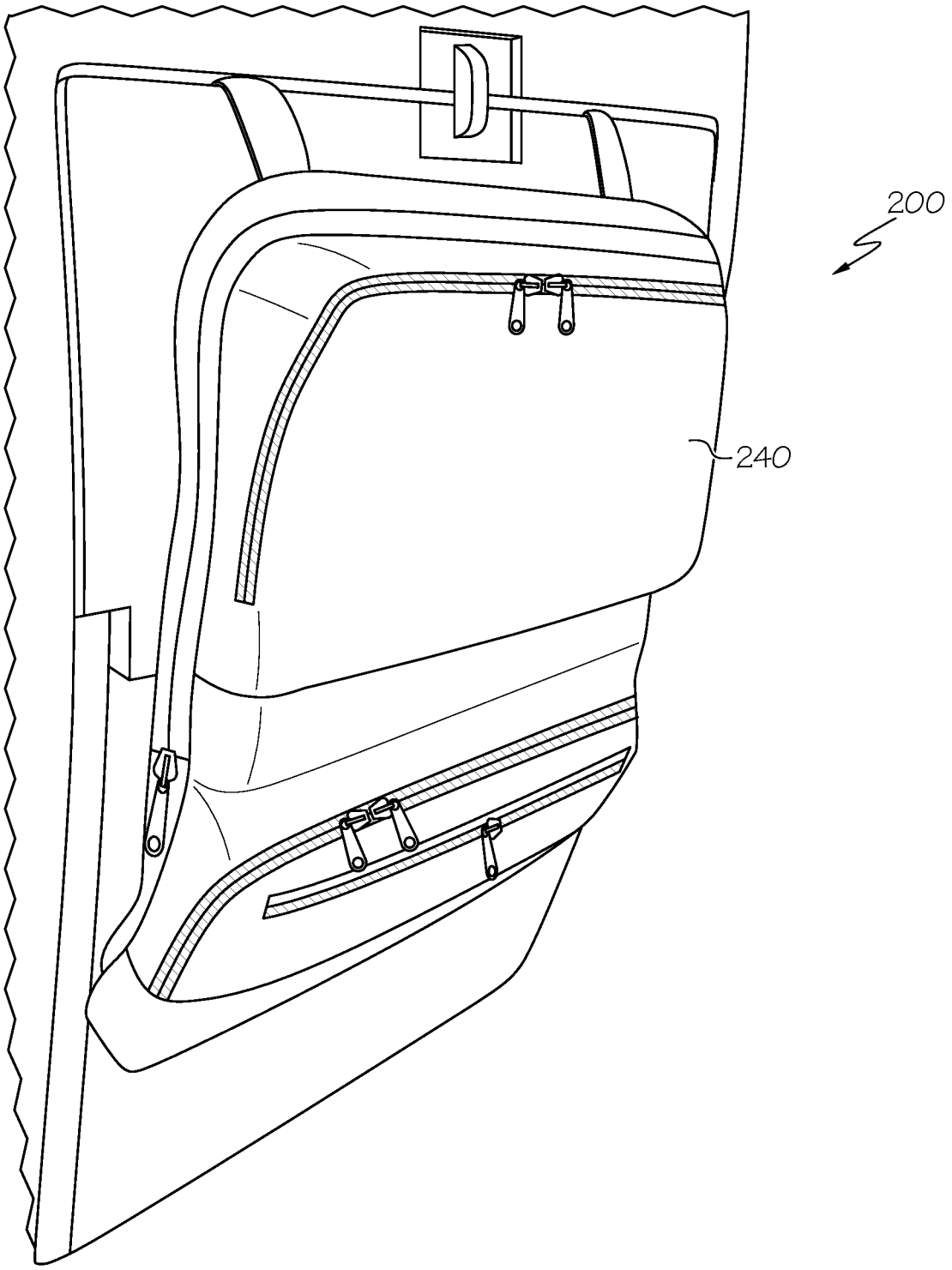
FIG. 25 is a perspective view of an embodiment of a second body coupled to a seat in accordance with the present inventive concepts.

FIG. 25 is a perspective view of an embodiment of a second body 200 coupled to a seat in accordance with the present inventive concepts.

Figure 26:
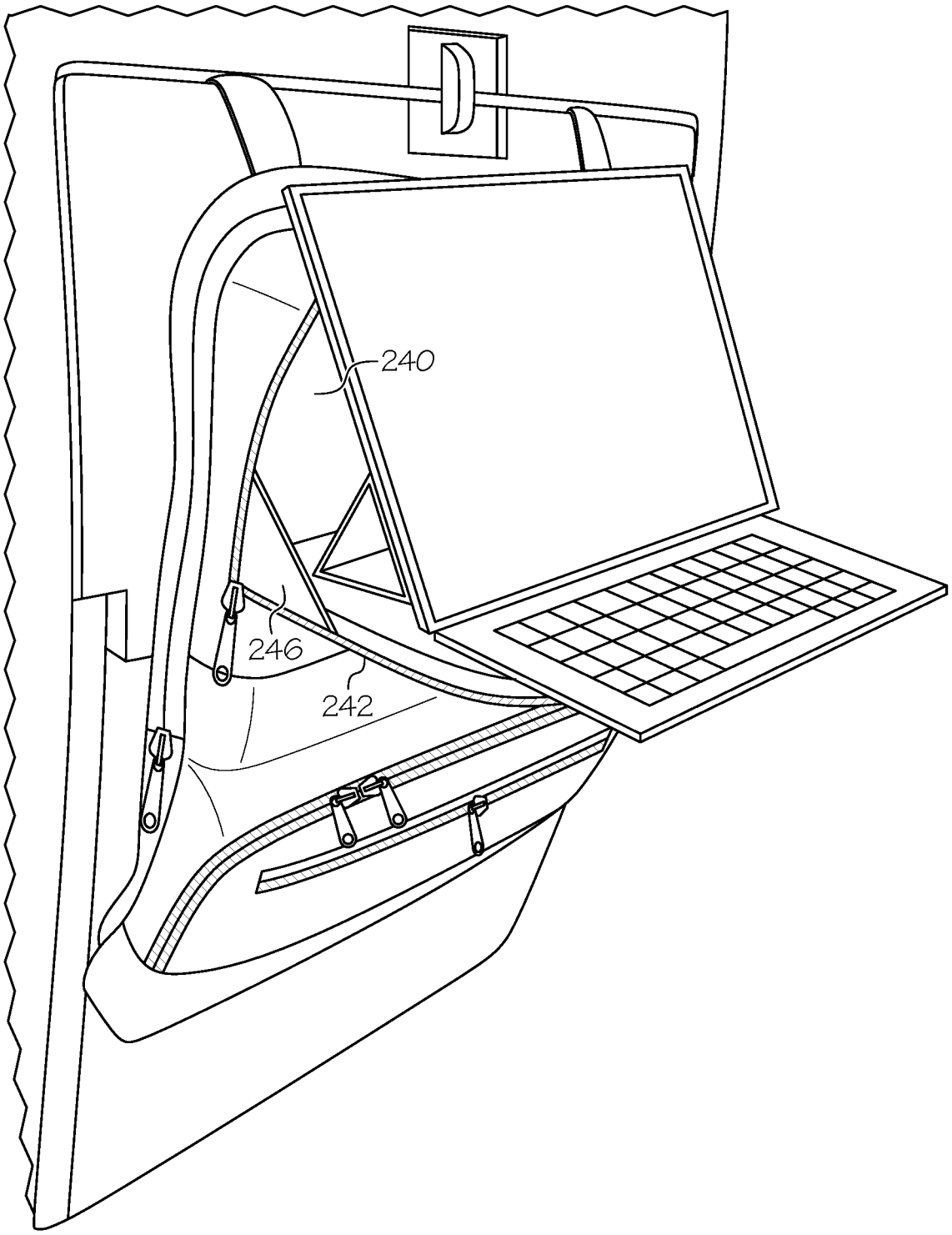
FIG. 26 is a perspective view of an embodiment of a second body coupled to a seat in accordance with the present inventive concepts.

FIG. 26 is a perspective view of an embodiment of a second body 200 coupled to a seat in accordance with the present inventive concepts. In this embodiment, the top front pocket 240 on the second body 200 is opened. In this embodiment, the top front pocket 240 comprises a first portion 242. The first portion 242 of the front pocket 240 is constructed and arranged to extend in a direction transverse to the first axis 940. In the embodiment shown in FIG. 26, the first portion 242 of the front pocket 240 is coupled to a second portion 244 of the front pocket 240 with webbing 246. In the embodiment shown in FIG. 30, the first portion 242 of the front pocket 240 is constructed and arranged to support a device such as a computer. In other embodiments the first portion 242 may support another type of device.

Figure 27:
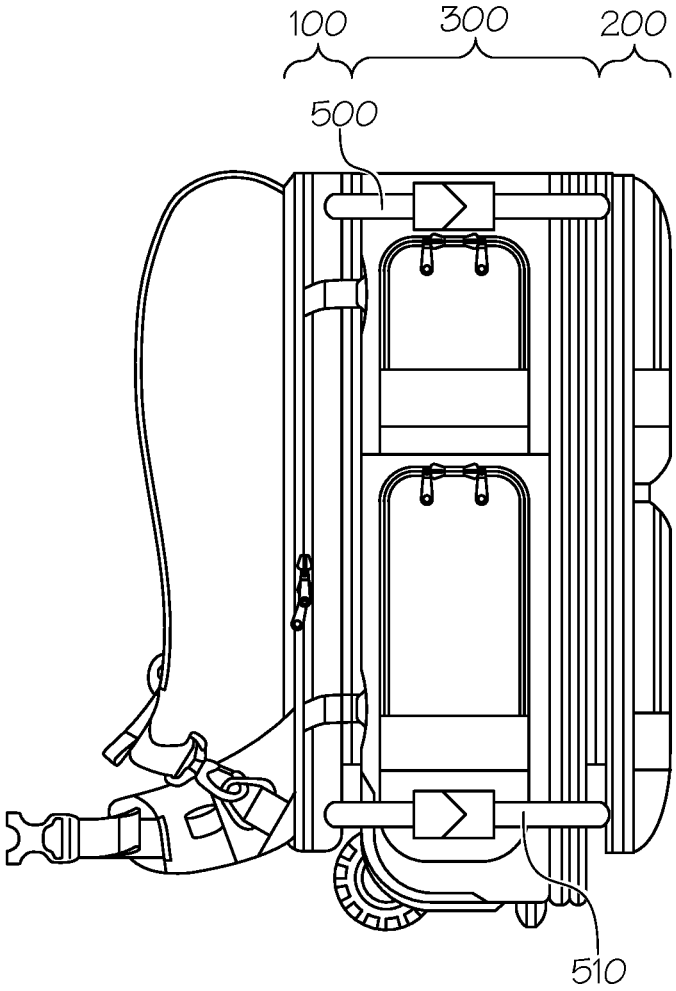
FIG. 27 is a side view of an embodiment of a first and second bodies attached to a suitcase in accordance with the present inventive concepts.

FIG. 27 is a side view of an embodiment of first 100 and second 200 bodies attached to a suitcase in accordance with the present inventive concepts. In some embodiments, the front unit 200 and the rear/suspension unit 100 can include straps 500 that can connect to each other with buckles 510, Velcro, or other mechanisms, to allow the front 200 and back 100 units to be strapped to a rolling suitcase, for example in a case where the rolling suitcase is manufactured by another party and/or is absent of the attachment mechanisms described herein. This allows customers who already own a third party suitcase to apply the front 200 and rear 100 units of the present inventive system, and still receive some of the inventive advantages. In various embodiments, this functionality may also be accomplished by other means, such as pass-through sleeves on the front 200 and rear 100 units, through which straps 500 can be passed. In some embodiments, the straps 500 are fixed to the rear 100 and/or front 200 units.

The above-described embodiments should be understood to serve only as illustrative examples; further embodiments are envisaged. Any feature described herein in relation to any one embodiment may be used alone, or in combination with other features described, and may also be used in combination with one or more features of any other of the embodiments, or any combination of any other of the embodiments. Furthermore, equivalents and modifications not described above may also be employed without departing from the scope of the specification, which is defined in the accompanying claims.

We claim:

1. A system, comprising:

a first body, comprising:

a backpack suspension;

a first storage region; and a first portion of a first attachment mechanism;

a second body, comprising:

a second storage region; and a first portion of a second attachment mechanism; and a third body, comprising:

a third storage region;

a second portion of the first attachment mechanism; and a second portion of the second attachment mechanism, wherein:

in a first configuration, the first portion of the first attachment mechanism is coupled to the first portion of the second attachment mechanism; and in a second configuration, the first portion of the first attachment mechanism is coupled to the second portion of the first attachment mechanism, and the first portion of the second attachment mechanism is coupled to the second portion of the second attachment mechanism, wherein the first attachment mechanism comprises a left side leg, a right side leg, and a horizontal portion, a first end of the horizontal portion connected to a top of the left side leg and a second end of the horizontal portion connected to a top of the right side leg, wherein the second attachment mechanism comprises a left side leg, a right side leg, and a horizontal portion, a first end of the horizontal portion connected a top of the left side leg and a second end of the horizontal portion connected a top of the right side leg.

2. The system of claim 1, wherein a spatial arrangement of the first portion of the first attachment mechanism matches a spatial arrangement of the first portion of the second attachment mechanism, wherein a spatial arrangement of the first portion of the first attachment mechanism matches a spatial arrangement of the second portion of the first attachment mechanism, and wherein a spatial arrangement of the first portion of the second attachment mechanism matches a spatial arrangement of the second portion of the second attachment mechanism.

3. The system of claim 1, wherein the third body further comprises a front region and a rear region, wherein the front region comprises the second portion of the second attachment mechanism, wherein the rear region comprises the second portion of the first attachment mechanism, and wherein the front region and the rear region are positioned at opposite sides of the third body.

4. The system of claim 1, wherein the first body further comprises:

a first section constructed and arranged to store a computer in a TSA-approved manner such that it may be screened without being removed from the first section;

a second section;

a hinge that couples a proximal end of the first section to a proximal end of the second section; and an access mechanism that couples the distal end of the first section to the distal end of the second section, wherein the hinge of the first body is constructed and arranged to rotate at least 180 degrees, wherein the second section of the first body comprises a pocket constructed and arranged to store a computer.

5. The system of claim 1, wherein the first body is removably coupled to a first region of the third body, and wherein the second body is removably coupled to a second region of the third body.

6. The system of claim 1, wherein the first attachment mechanism comprises a zipper and the second attachment mechanism comprises a zipper.

7. The system of claim 1, wherein the backpack suspension comprises at least one shoulder strap.

8. The system of claim 1, wherein the backpack suspension comprises a hip belt.

9. The system of claim 8, wherein the hip belt comprises at least one crease at which the hip belt can be folded and stored at a hip belt stowaway compartment.

10. The system of claim 1, wherein the second body comprises at least one shoulder strap.

11. The system of claim 10, wherein the at least one shoulder strap comprises:

a first portion, a proximal end of which is coupled to an upper region of the second body; and a second portion, a proximal end of which is coupled to a lower region of the second body.

12. The system of claim 1, wherein at least a portion of the left side leg of the first attachment mechanism extends in a direction parallel to a left sidewall of the third body, at least a portion of the right side leg of the first attachment mechanism extends in a direction parallel to a right sidewall of the third body, at least a portion of the horizontal portion of the first attachment mechanism extends in a direction along parallel to a top sidewall of the third body, and wherein at least a portion of the left side leg of the second attachment mechanism extends in a direction parallel to a left sidewall of the third body, at least a portion of the right side leg of the second attachment mechanism extends in a direction parallel to a right sidewall of the third body, at least a portion of the horizontal portion of the second attachment mechanism extends in a direction along parallel to a top sidewall of the third body.

13. The system of claim 12, wherein the left side leg and right side leg of the first attachment mechanism are parallel to each other, and wherein the left side leg and right side leg of the second attachment mechanism are parallel to each other.

14. The system of claim 1, wherein, in the second configuration a bottom of the first body is at a first height relative to a lowermost position of the third body.

15. A system, comprising:

a first body, comprising:

a backpack suspension;

a first storage region; and a first portion of a first attachment mechanism;

a second body, comprising:

a second storage region; and a first portion of a second attachment mechanism; and a third body, comprising:

a third storage region;

a second portion of the first attachment mechanism; and a second portion of the second attachment mechanism, wherein:

in a first configuration, the first portion of the first attachment mechanism is coupled to the first portion of the second attachment mechanism; and in a second configuration, the first portion of the first attachment mechanism is coupled to the second portion of the first attachment mechanism, and the first portion of the second attachment mechanism is coupled to the second portion of the second attachment mechanism, wherein the first attachment mechanism comprises an upside-down-U-shaped configuration, wherein the second attachment mechanism comprises an upside-down-U-shaped configuration.

16. A system, comprising:

a first body, comprising:

a backpack suspension;

a first storage region; and a first portion of a first attachment mechanism;

a second body, comprising:

a second storage region; and a first portion of a second attachment mechanism; and a third body, comprising:

a third storage region;

a second portion of the first attachment mechanism; and a second portion of the second attachment mechanism, wherein:

in a first configuration, the first portion of the first attachment mechanism is coupled to the first portion of the second attachment mechanism; and in a second configuration, the first portion of the first attachment mechanism is coupled to the second portion of the first attachment mechanism, and the first portion of the second attachment mechanism is coupled to the second portion of the second attachment mechanism, wherein the first attachment mechanism comprises a single zipper comprising a left side leg, a right side leg, and a horizontal portion, and wherein the second attachment mechanism comprises a single zipper comprising left side leg, a right side leg, and a horizontal portion.

17. A system, comprising:

a first body, comprising:

a backpack suspension;

a first storage region; and a first portion of a first attachment mechanism;

a second body, comprising:

a second storage region; and a first portion of a second attachment mechanism; and a third body, comprising:

a third storage region;

a second portion of the first attachment mechanism; and a second portion of the second attachment mechanism, wherein:

in a first configuration, the first portion of the first attachment mechanism is coupled to the first portion of the second attachment mechanism; and in a second configuration, the first portion of the first attachment mechanism is coupled to the second portion of the first attachment mechanism, and the first portion of the second attachment mechanism is coupled to the second portion of the second attachment mechanism, wherein the first attachment mechanism comprises two corner regions and the second attachment mechanism comprises two corner regions.

18. The system of claim 1, further comprising at least one compression strap.

19. The system of claim 18, wherein a first length of the at least one compression strap is adjustable.

20. The system of claim 1, wherein the second body further comprises at least one side pocket.

* * * * *